US008186093B1

(12) United States Patent
Chung

(10) Patent No.: US 8,186,093 B1
(45) Date of Patent: May 29, 2012

(54) DOT SIGHT DEVICE OF PLURALITY OF CALIBERS

(75) Inventor: Sung Giu Chung, McLean, VA (US)

(73) Assignee: International Trade and Technologies, Inc., McLean, VA (US)

( * ) Notice: Subject to any disclaimer, the term of this patent is extended or adjusted under 35 U.S.C. 154(b) by 0 days.

(21) Appl. No.: 13/304,082

(22) Filed: Nov. 23, 2011

Related U.S. Application Data

(63) Continuation-in-part of application No. 13/179,154, filed on Jul. 8, 2011.

(51) Int. Cl.
*F41G 1/30* (2006.01)
*F41G 1/34* (2006.01)

(52) U.S. Cl. ..... 42/113; 42/119

(58) Field of Classification Search ..... 42/113, 42/114, 119, 123, 131; 235/404, 405, 414, 235/417; 356/251; 362/110, 114
See application file for complete search history.

(56) References Cited

U.S. PATENT DOCUMENTS

2010/0275495 A1 11/2010 Jung et al.

*Primary Examiner* — Bret Hayes
(74) *Attorney, Agent, or Firm* — Birch, Stewart, Kolasch & Birch, LLP

(57) ABSTRACT

A dot sight device is discussed, which includes a window frame enclosing a transparent lens; a body plate extending from the window frame; a light emitter disposed on the body plate, and configured to emit a light that forms a pattern on the transparent lens; two bolts to mount the dot sight device on various fire arms without tools; a large water drainage hole disposed on the body plate; multiple rails installed on the window frame to accommodate various equipment; an IR detector disposed at the front of the body plate; a caliber adjustment knob disposed on the body plate, and configured to enable targeting by firearms of different calibers; and a dual bullet drop compensation wheel disposed in the body plate for an accurate aiming and hitting targets using various firearms.

22 Claims, 46 Drawing Sheets

Rounded Pentagon Shape 907

DOT SIGHT DEVICE OF PLURALITY OF CALIBERS

CROSS REFERENCE TO RELATED APPLICATION

This application is a continuation-in-part of co-pending U.S. application Ser. No. 13/179,154 filed on Jul. 8, 2011, the disclosure of which is incorporated by reference.

BACKGROUND OF THE INVENTION

1. Field of the Invention

Embodiments of the invention relate to a dot sight device that is designed and built for firearms, especially heavy and medium size machine guns, for the purpose of all armed forces, hunters, and police departments. A dot sight device offers a very large field of view design that provides rapid target acquisition for both stationary and moving targets. In addition, a dot sighting device also provides pin-point accuracy, which ensures every round is on target to ultimately suppress enemies faster, reduce collateral damage, and conserve ammunition.

2. Discussion of the Related Art

Iron sights are commonly used by shooters for aiming firearms such as rifles, or medium and heavy machine guns. Each iron sight requires the shooter to align a rear and front sights of a rifle along with the target, which requires trainings and shooting skills.

Dot sights were developed for the purpose of offering rapid target acquisition of both stationary and moving targets with limited training. A dot sight can easily convert non-experienced shooter into a skilled marksman. A dot sight is also commonly known as a non-magnifying reflector (or reflex) sight that is mounted on firearms to provide the shooter an aiming indication in the form of a red dot. Dot sights are designed and developed to offer sportsmen, hunters, policemen and soldiers the ability to acquire and engage target or targets quickly and effectively. Dot sights are user friendly devices in the sense that it only requires the shooter to position the dot on the target and upon pulling the trigger, a projectile will impact the point of aim.

A standard dot sight design uses a red light-emitting diode (LED) at the focus of collimating optics, which generates a red dot or an illuminated reticle that stays in alignment with the weapon. The dot sight then may be attached to the weapon regardless of an eye position (i.e., parallax free).

A dot sight can also use an infrared light source at the focus of the collimating optics to generate a light that is invisible to the human eye. By using an IR coating technology, an illuminated reticle will then be visible at the lens that stays in alignment with the weapon. The dot sight then may be attached to the weapon regardless of eye position (i.e., parallax free).

A parallax free dot sight refers to a visible dot that remains parallel to a bore of the firearm, so no matter what position the shooter's eye is in, it will remain relative to the sight allowing the shooter to engage target or targets in stationary or moving platforms (i.e.—helicopters and boats).

A very large field of view design enables the shooter to keep both eyes open during operation to enable an unlimited field of view at any distance. The eye relief is also unlimited, which means that the shooter's eye position behind the sight does not affect how well the shooter sees the target.

Shooting with both eyes open offers the shooter enhanced situational awareness to allow the possibility to deal with multiple targets. A dot sight helps a shooter become an effective marksman offering ability to aim accurately and quickly under any extreme or stressful conditions.

SUMMARY OF THE INVENTION

An object of an embodiment of the invention is to provide a dot sight device that offers a shooter capabilities to engage single or multiple targets as quickly as possible while delivering accuracy in a user-friendly device.

An object of an embodiment of the invention is to provide a dot sight device that allows for installing other devices such as laser pointers, flash lights, illuminators, laser range finders, night vision devices, and thermal cameras thereto. More than 2 rails may be installed to the dot sight device.

An object of an embodiment of the invention is to provide a dot sight device, which may be used to aim at targets in far distances by using a fixed or moveable magnifier. With a built-in magnifier (flip type or swing type), a firearm can be quickly converted into sniper rifle to engage targets at long distances.

An object of an embodiment of the invention is to provide a dot sight device that may be used to aim at targets during any night operations by offering a quick installation of night vision or thermal cameras on pre-installed rails.

Another object of an embodiment of the invention is to offer user friendly installation of a sight. Tools used to install sights are usually lost during training and deployments. The dot sight is designed to be installed without a special tool or wrench that mounts and dismounts the dot sight from the firearm.

Another object of an embodiment of the invention is to install a protective window or honeycomb or filter in front of the lens to prevent or reduce scratches or accumulation of dirt and other foreign objects to ultimately increase the dot sight's service life and protect a shooter from disclosing his/her location to enemy snipers due to reflection off of the lens or emission of the red dot.

Another object of an embodiment of the invention is to provide a dot sight device that may be used with various caliber arms. A dot sight device can be used with multiple firearms as it offers multiple ballistic drop compensation devices (7.62 mm and 12.7 mm or 5.56 mm and 7.62 mm) to designate one sight for multiple firearms with different ballistics.

Another object of an embodiment of the invention is to provide a dot sight device which is able to automatically control a brightness of a targeting dot.

Another object of an embodiment of the invention is to provide a dot sight device that capable of removing any accumulated moisture quickly.

Another object of an embodiment of the invention is to provide a dot sight device capable of quickly sighting targets at various distances. The shooter will be able to aim accurately and quickly under a variety of conditions.

Another object of an embodiment of the invention is to provide a dot sight device with a battery cap holder to prevent any misplacement.

Another object of an embodiment of the invention is to provide a dot sight device with a light emitter that is not obstructed.

Another object of an embodiment of the invention is to provide a dot sight device which is able emit an infrared (IR) light to the sight's lens. An IR light is invisible to human eye and using a special IR coating on the lens, only the shooter will be able to see a red dot.

Another object of an embodiment of the invention is to provide a dot sight device that offers a single or multiple bullet drop compensation devices by moving/changing an angle of the LED or IR light source.

Another object of an embodiment of the invention is to provide a dot sight device that can receive target distance information (200 m-2000 m) from a laser range finder and automatically control a bullet drop compensation unit for quick, easy, and accurate target acquisition.

Another object of an embodiment of the invention is to offer wide range of lens sizes to accurate any soldier's requirements to display information required to effectively and quickly engage targets.

To achieve these and other advantages and in accordance with the purpose of this invention, as embodied and broadly described, a dot sight includes, 2-3 rails, protective windows/filters/honeycomb, auto brightness control, magnification devices, ability to install other military equipment, and others.

Additional features and advantages of this invention will be set forth in the description which follows, and in part will be apparent from the description, or may be learned by practice of this invention. The objectives and other advantages of this invention will be realized and attained by the structure particularly pointed out in the written description and claims thereof as well as the appended drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1A:
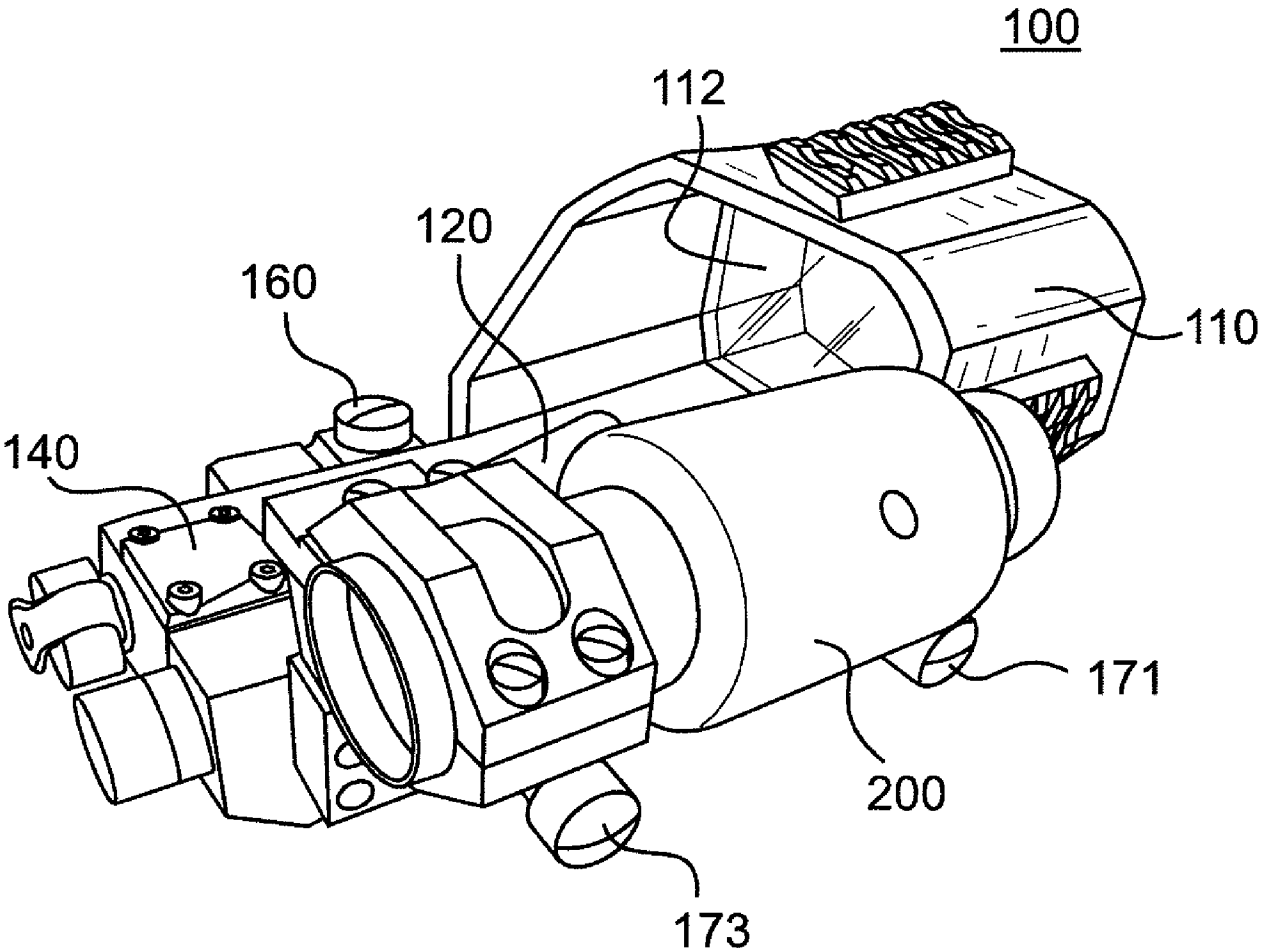
FIG. 1A shows a perspective view of the dot sight device according to an example embodiment of the invention.

Hereinafter, example embodiments of this invention will be described in detail with reference to FIGS. 1A-13. Like reference numerals designate like elements throughout the specification.

Figure 1B:
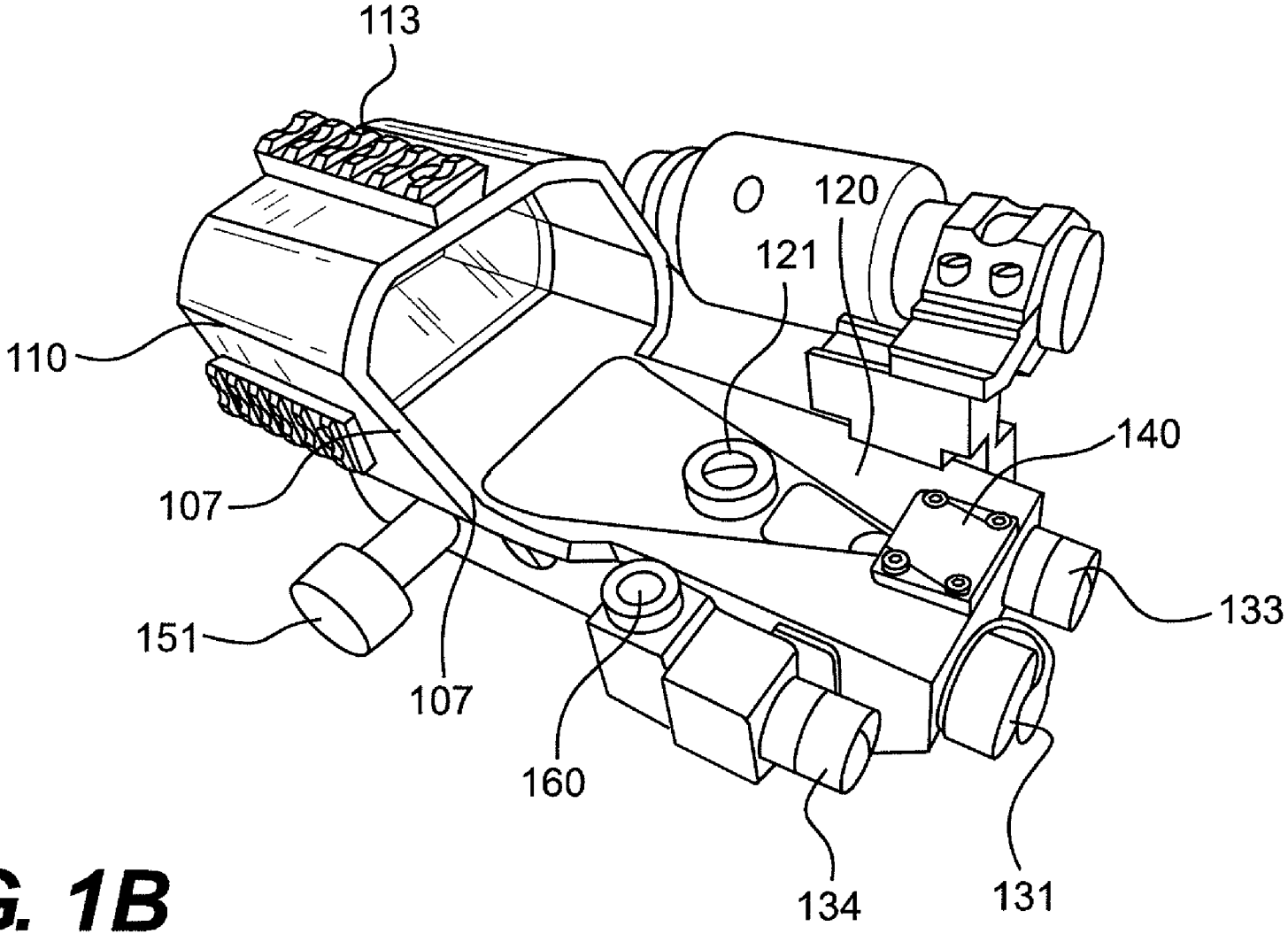
FIG. 1B shows another perspective view of the dot sight device according to an example embodiment of the invention.
Figure 1C:
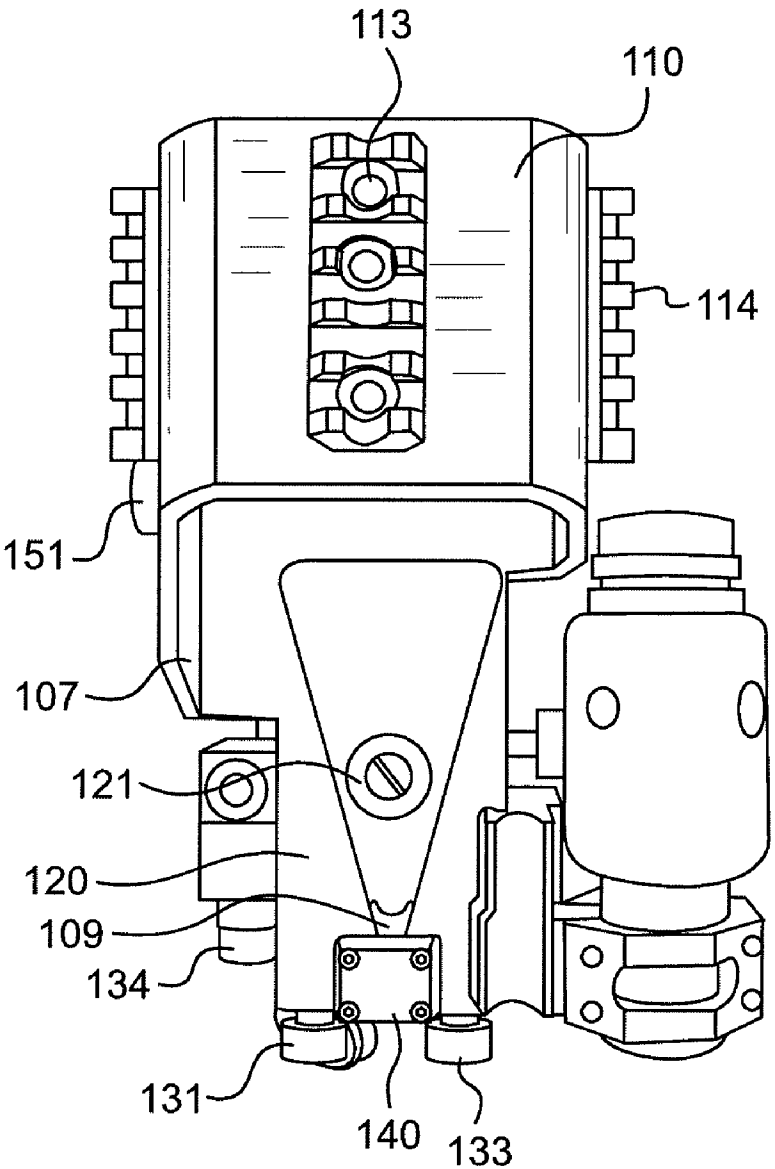
FIG. 1C shows a top plan view of the dot sight device according to an example embodiment of the invention.
Figure 1D:
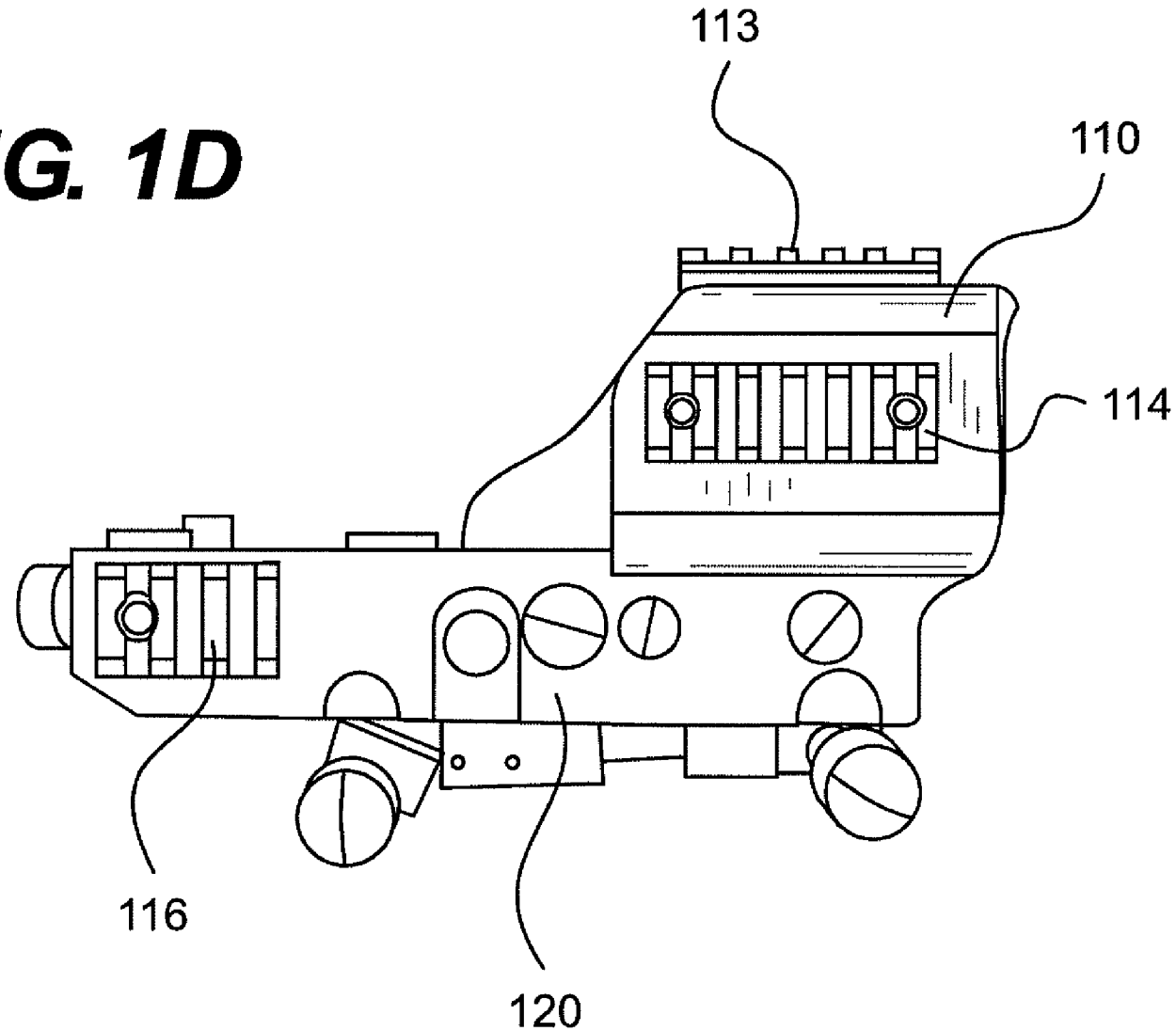
FIG. 1D shows a right side view of the dot sight device according to an example embodiment of the invention.

FIG. 1A shows a perspective view of the dot sight device according to an example embodiment of the invention. FIG. 1B shows another perspective view of the dot sighting device according to an example embodiment of the invention. FIG. 1C shows a top plan view of the dot sight device according to an example embodiment of the invention. FIG. 1D shows a right side view of the dot sight device according to an example embodiment of the invention.

Figure 10A:
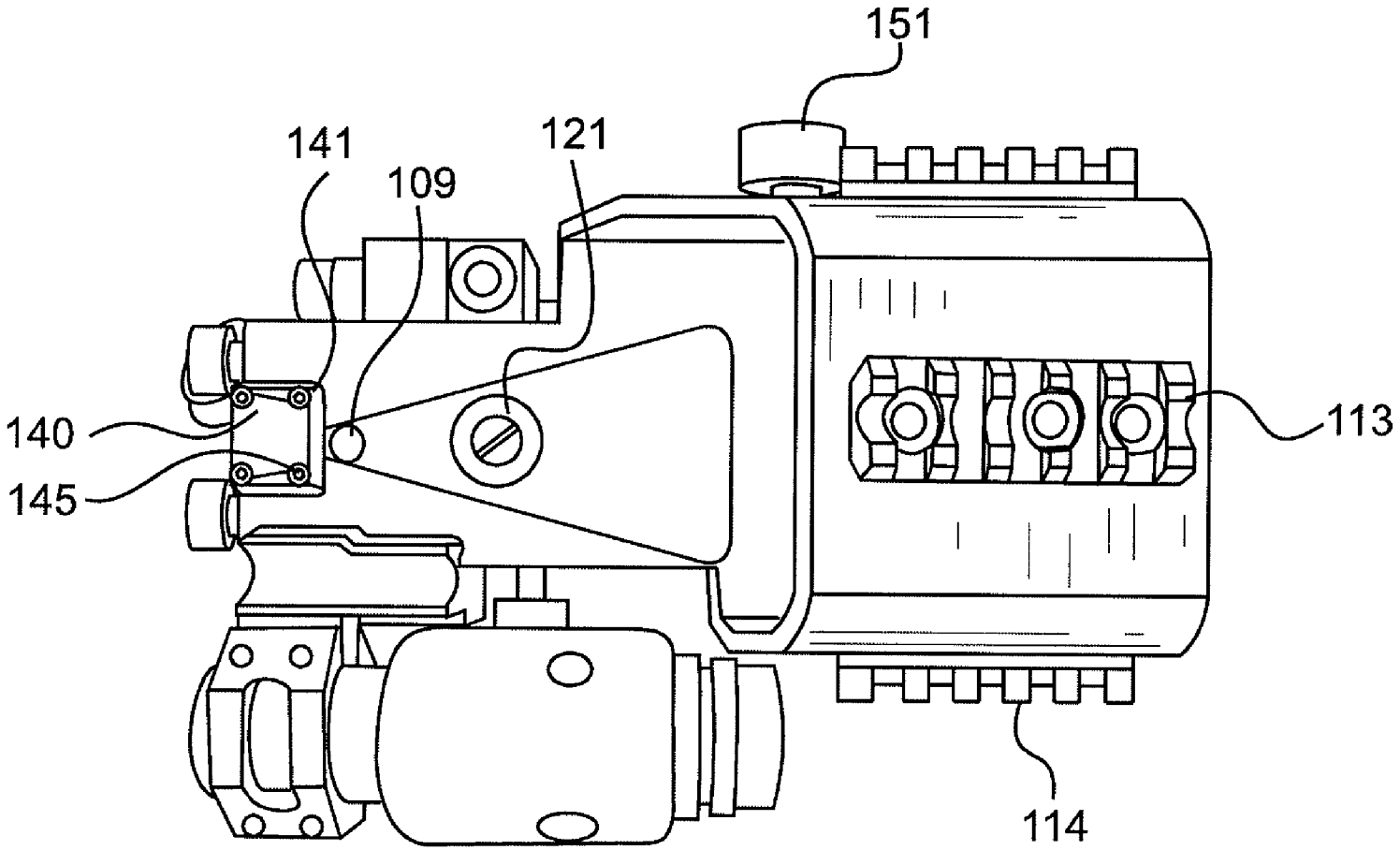
FIG. 10A shows another top plan view of the dot sight device according an example embodiment of the invention.
Figure 10B:
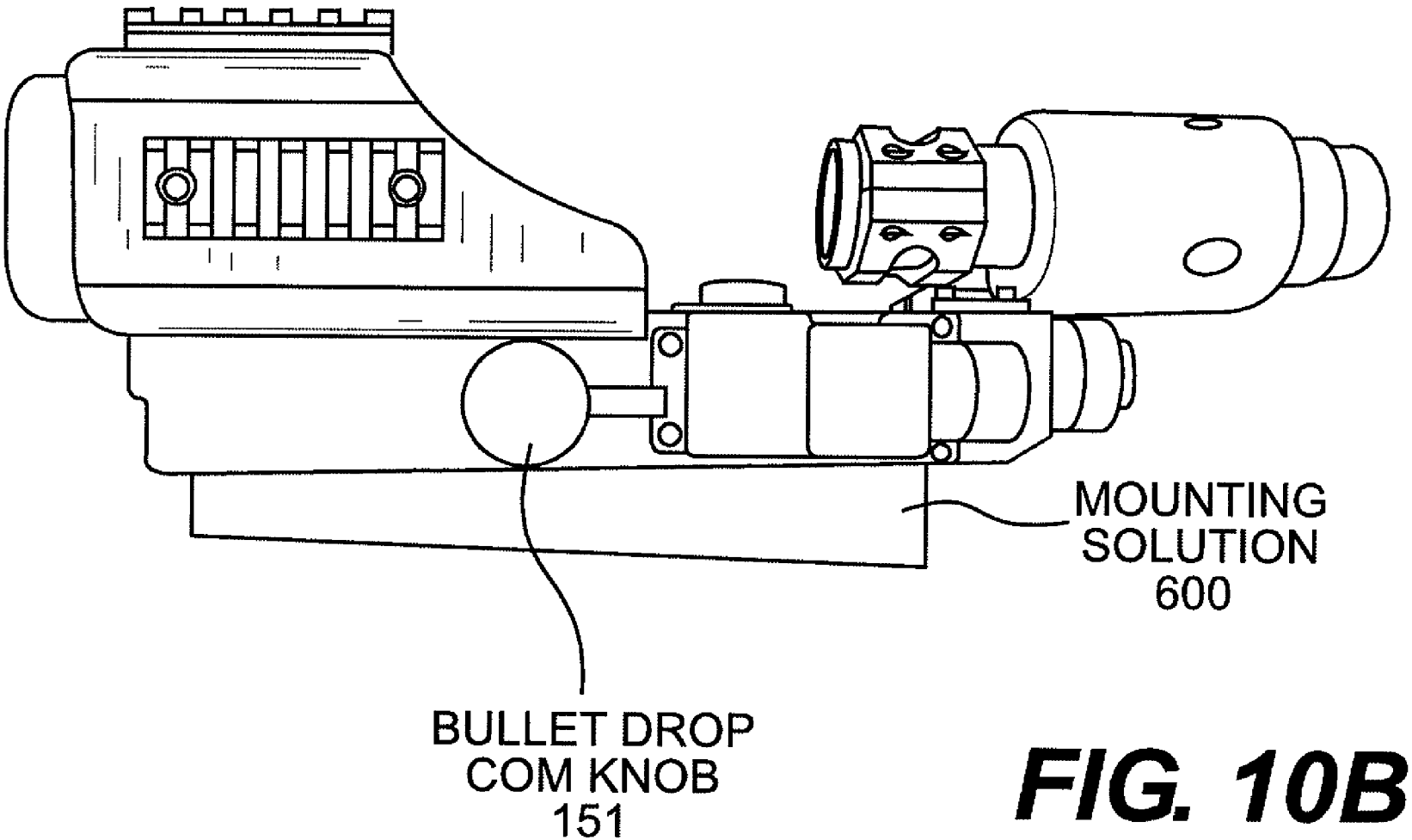
FIG. 10B shows a left side view of a dot sight device with a bullet drop compensation device according to an example embodiment of the invention.
Figure 10C:
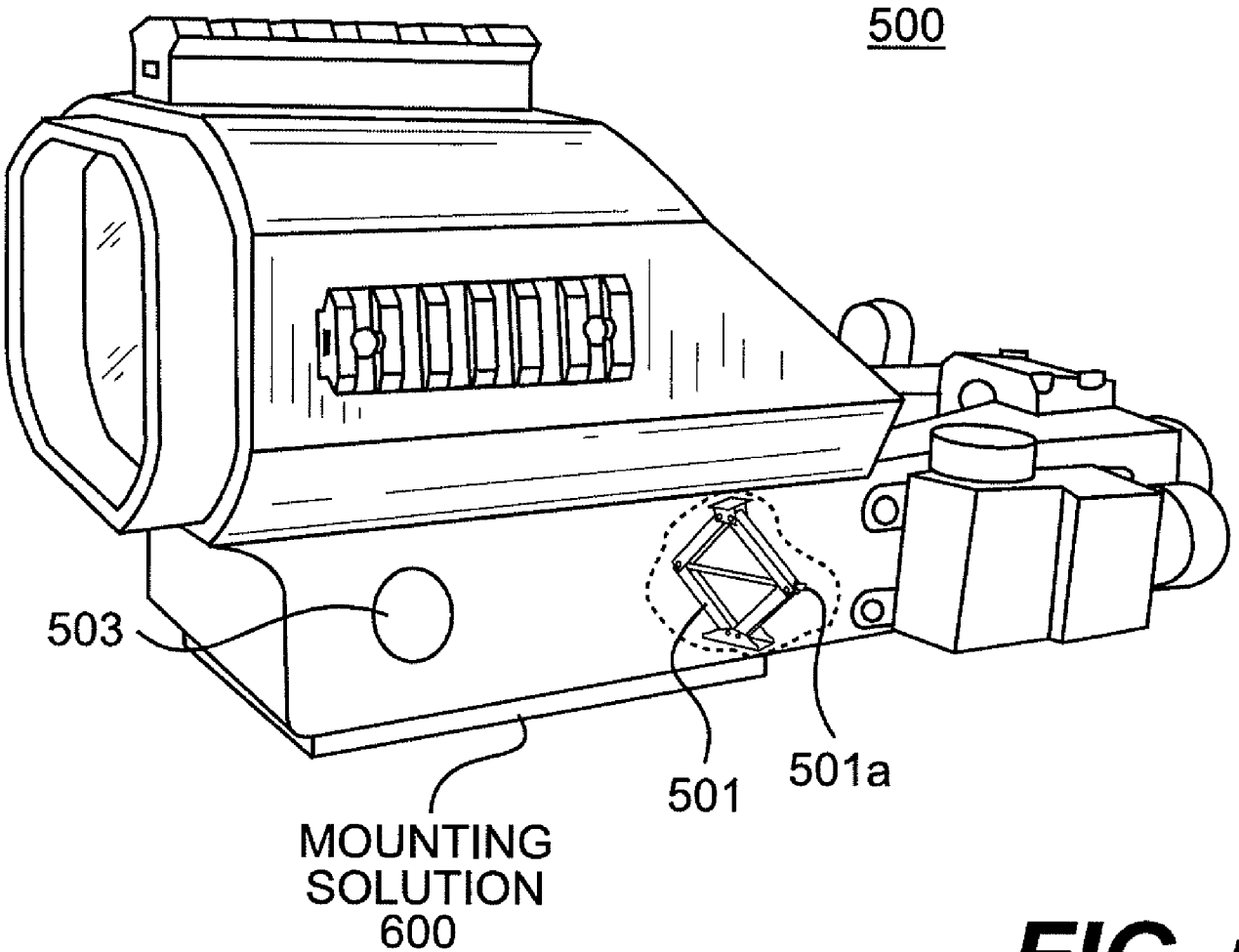
FIG. 10C shows a scissor jack type bullet drop compensation device accordance to an example embodiment of the invention.
Figure 10D:
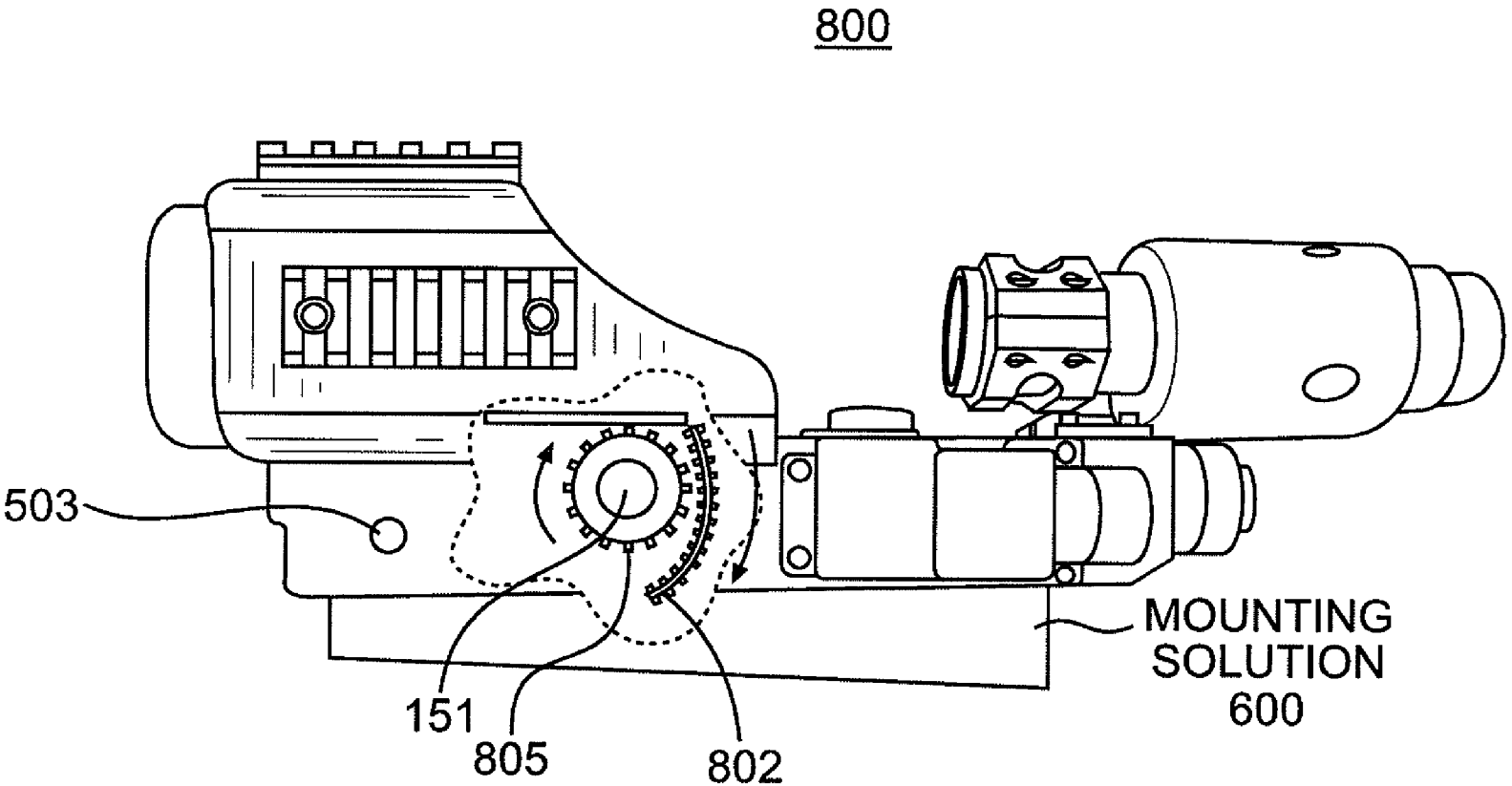
FIG. 10D shows an inside view of a gear type bullet drop compensation device accordance to an example embodiment of the invention.
Figure 10E:
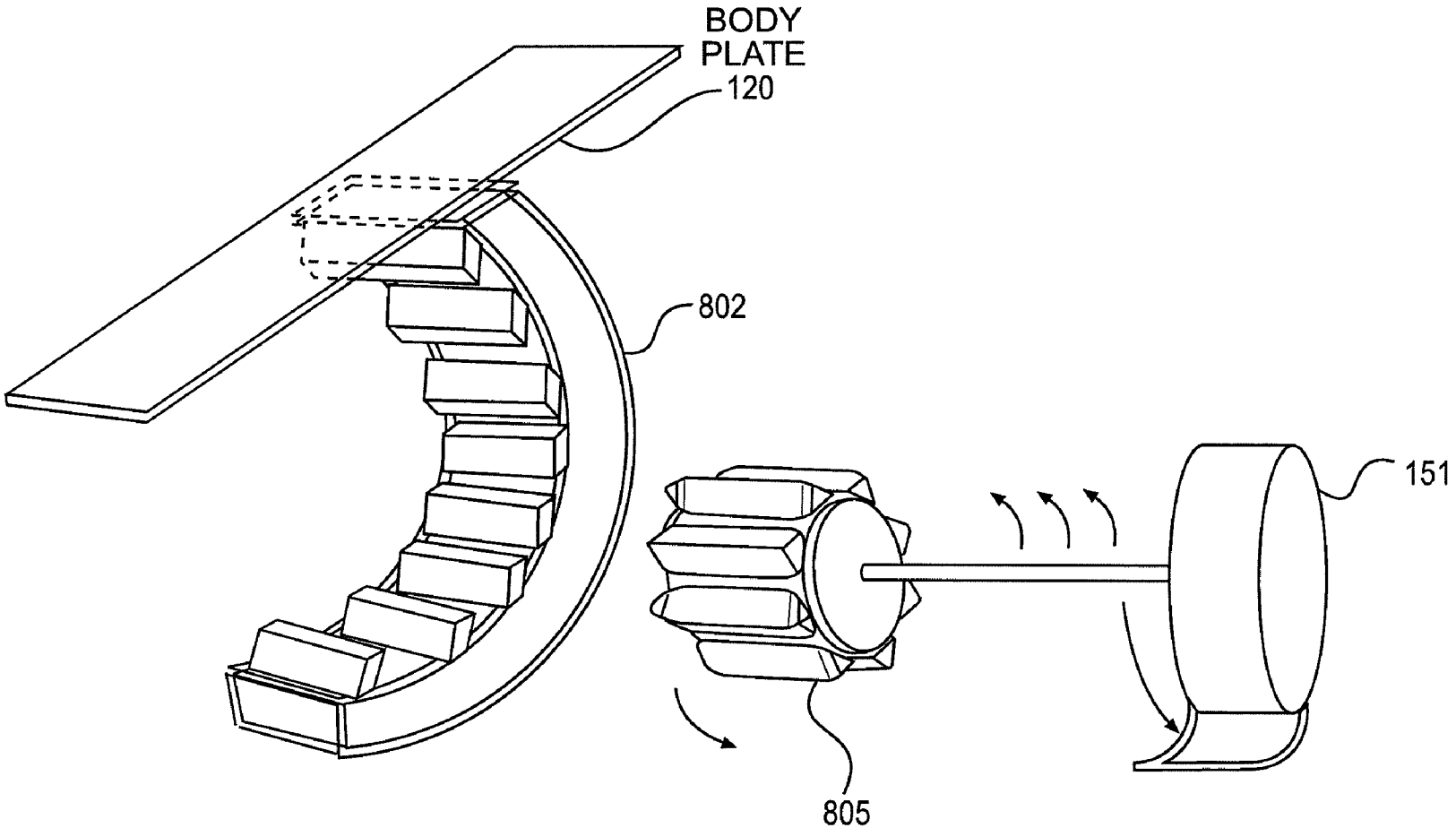
FIG. 10E shows an inside view of the gear type bullet drop compensation device accordance to an example embodiment of the invention.
Figure 10F:
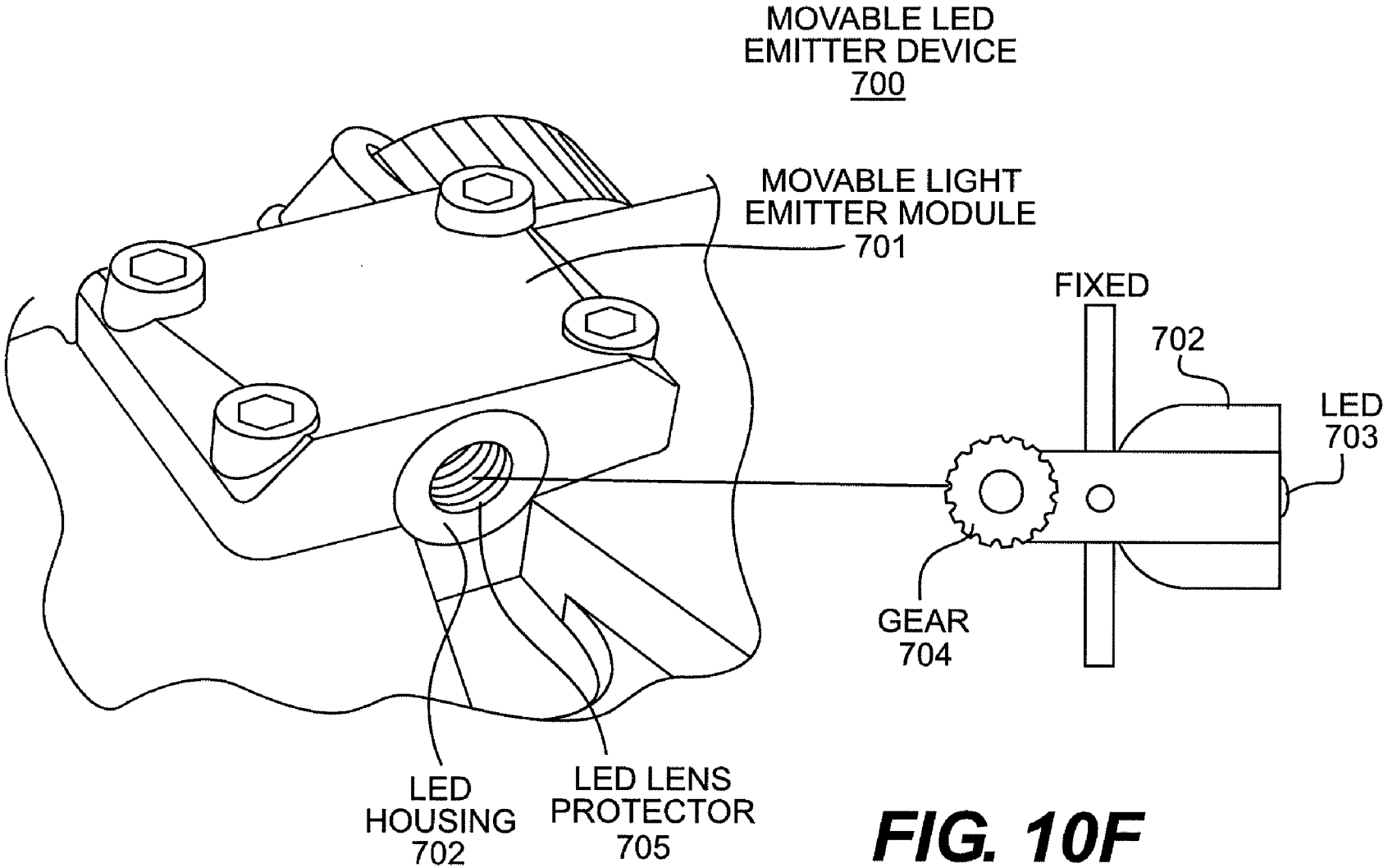
FIG. 10F shows a movable LED emitter device according to an example embodiment of the invention.
Figure 10G:
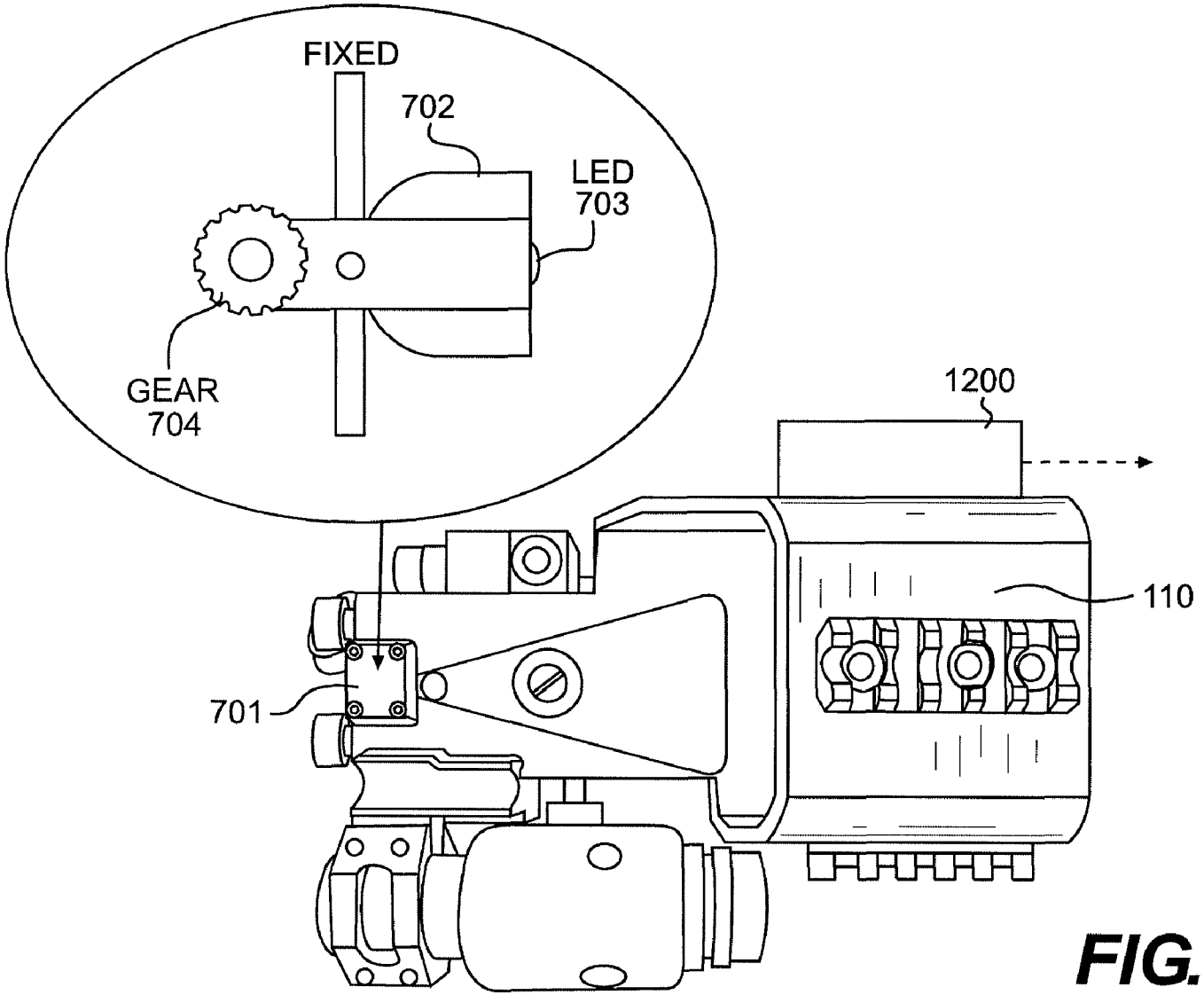
FIG. 10G shows a range finder to control automatically a bullet drop compensation device for the dot sight device according to an example embodiment of the invention.

A dot sight device 100 according to an example embodiment of the invention generally includes a window frame 110, a body plate 120, a light emitter (or a light emitter housing) 140, and optional devices such as a magnifier 200 and a laser range finder 1200 (see FIG. 10G). In an embodiment of the invention, the dot sight device 100 may be referred to as an automated dot sight device when a sighting of a target can be performed automatically. As shown in FIG. 1A and in greater detail, the dot sighting device 100 includes a window frame 110 supporting a transparent lens 112, and the body plate 120 that supports a first bolt 171 and a second bolt 173 used in attaching the dot sight sighting device 100 to various caliber firearms. The bolts 171 and 173 eliminate the need for wrenches that can be misplaced or lost. The window frame 110 is also a platform for mounting the laser range finder 1200. The body plate 120 is also a platform for mounting a brightness detector 160, which may be an automatic brightness detector, and a magnifier 200. In the embodiment of the invention, the window frame 110 is positioned at a first end (or a front end) of the dot sighting device 100 and the magnifier 200 is positioned towards a second end (or a back end) of the dot sighting device 100.

As shown in FIG. 1B and in greater detail, the window frame 110 supports one or more rails 113, and the body plate 120 supports a bullet drop compensation knob 151, a light emitter (or a light emitter housing) 140, a battery case 131, and an auto or manual brightness switch 133. Additionally, a side wall 107 connects the window frame 110 and the body plate 120. A sidewall is not formed on the opposite side of the dot sighting device 100 in order to secure clearance for the magnifier 200. The battery case 131 may be attached to the body plate by a harness.

As shown in FIG. 1C and in greater detail, the window frame 110 supports a top rail 113 and one side rail 114. The body plate 120 supports the elevation control knob 121 in an interior of an enclosure, and which in this instance is located along a line between the top rail 113 and the light emitter (or the light emitter housing) 140. The body plate 120 also includes a drainage hole 109 that extends from a top surface to a bottom surface of the body plate 120. In this instance, the drainage hole 109 is located along the line between the top rail 113 and the light emitter (or the light emitter housing) 140, so that the elevation control knob 121 and the drainage hole 109 are collinear. In other embodiments, the elevation control knob 121 and the drainage hole 109 may be offset.

As shown in FIG. 1C, the body plate 120 additionally supports a battery case 131 and an auto or manual brightness switch 133 at the back end of the dot sight device 100. In the embodiment of the invention, the battery case 131 may be disposed to one side of the body plate 120 while the auto or manual brightness switch 133 is disposed to another side (i.e., the opposite side) of the body plate 120. The light emitter (or the light emitter housing) 140 is also disposed at the back end of the body plate 120. In an embodiment of the invention, the light emitter (or the light emitter housing) 140 is positioned to be in between the side walls 107 and a side rail 114.

As shown in FIG. 1D in detail, the top rail 113 may be installed on the top of the window frame 110 and the side rail 114 may be installed on the side of the window frame 110. Also, a third rail 116 may be installed on the back right-side edge of the body plate 120.

When a light, such as a light of red color, is emitted from the light emitter (or the light emitter housing) 140, and is incident on the transparent lens 112, a dot or a shape (or a pattern) is displayed on an incident surface of the transparent lens 112 so that a shooter simply needs to align the dot or the shape over a target for accurate targeting or sighting.

Figure 2A:
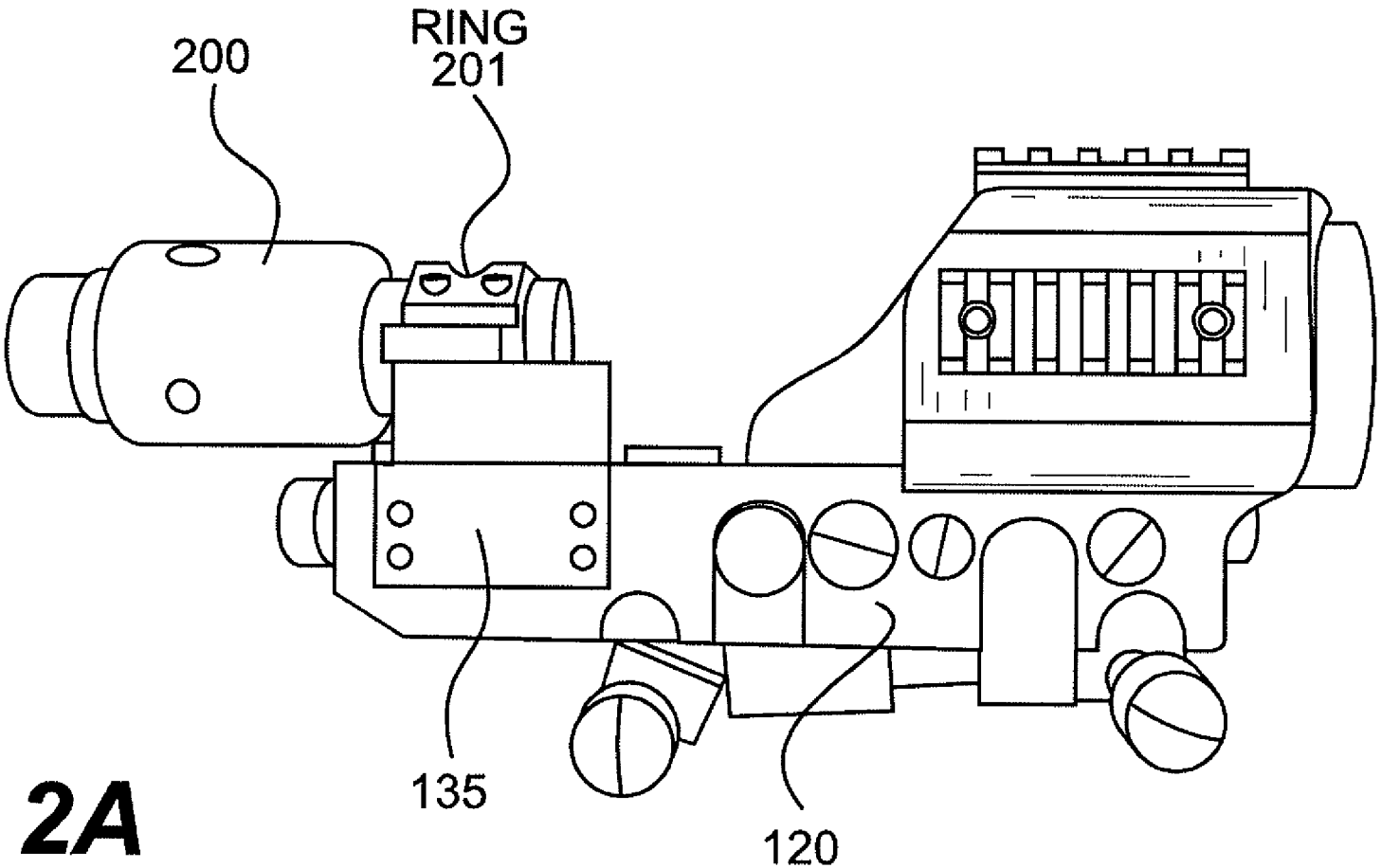
FIG. 2A shows a right side view of the dot sight device with a magnifier according to an example embodiment of the invention.

FIG. 2A shows a right side view of the dot sight device with the magnifier 200 installed and deployed according to an example embodiment of the invention. The front end of the magnifier 200 is installed through a ring 201, which in this case is attached to a mount 135, which may be a swing mount, and which is then mounted on the right side of the body plate 120.

Figure 2B:
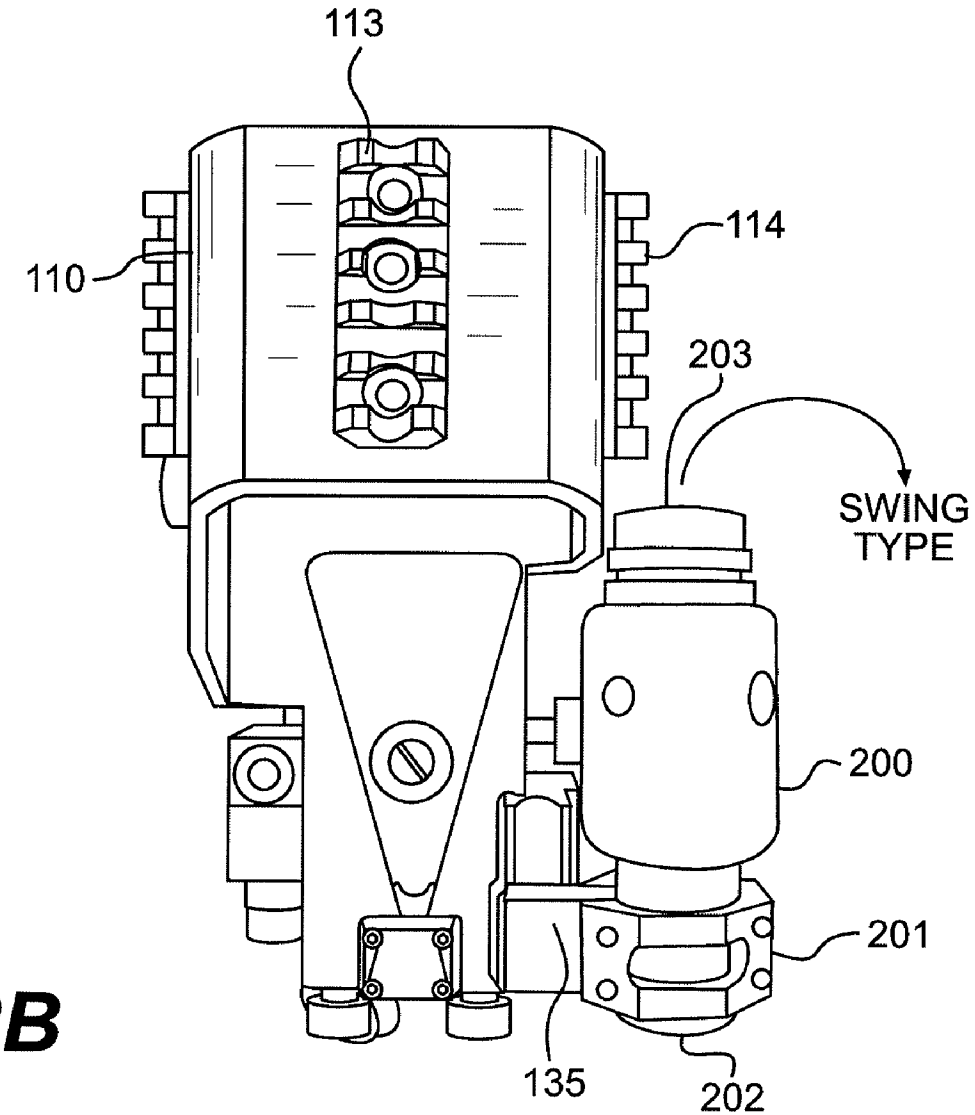
FIG. 2B shows a top plan view of the dot sight device with a swing type magnifier in a retracted position according to an example embodiment of the invention.

FIG. 2B shows a top plan view of the dot sighting device with a magnifier 200, which may be a swing type, in a retracted position according to an example embodiment of the invention. The window frame 110 supports the top rail 113 and the side rail 114. The magnifier 200 includes two lenses, a back lens 203 and a front lens 202. As shown in FIG. 2B and in greater detail, the magnifier 200 is placed through the ring 201 by placing or clamping the front lens 202 first through the ring 201. The ring 201 is attached to the swing mount 135, which can be mounted on the right side of the body plate 120. In this instance, the retracted magnifier 200 is positioned on the right side. The swing mount 135 serves as a fixed junction that allows the ring 201 to swing around a junction to extend or retract the deployed magnifier 200. In embodiments of the invention, the swing mount 135 may be a bracket or other movable fixing device.

Figure 2C:
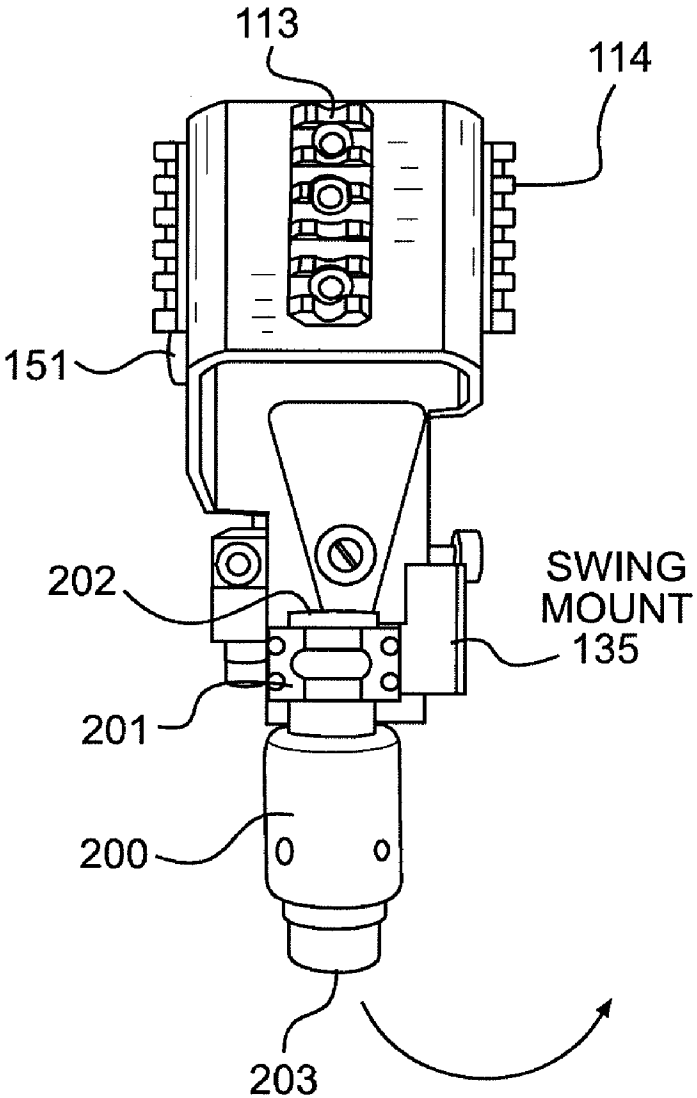
FIG. 2C shows a top plan view of the dot sight device with the swing type magnifier in a deployed position according to an example embodiment of the invention.

FIG. 2C shows a top plan view of a dot sight device with a magnifier 200, which may be a swing type, in a deployed position according to an example embodiment of the invention. The magnifier 200 again includes the front lens 202 and the back lens 203. The magnifier 200 is installed through the ring 201, which is attached to the swing mount 135. The magnifier 200 is deployed and retracted by swinging in and out a 180 degree around the swing mount 135 that serves as a pivot point.

Figure 2D:
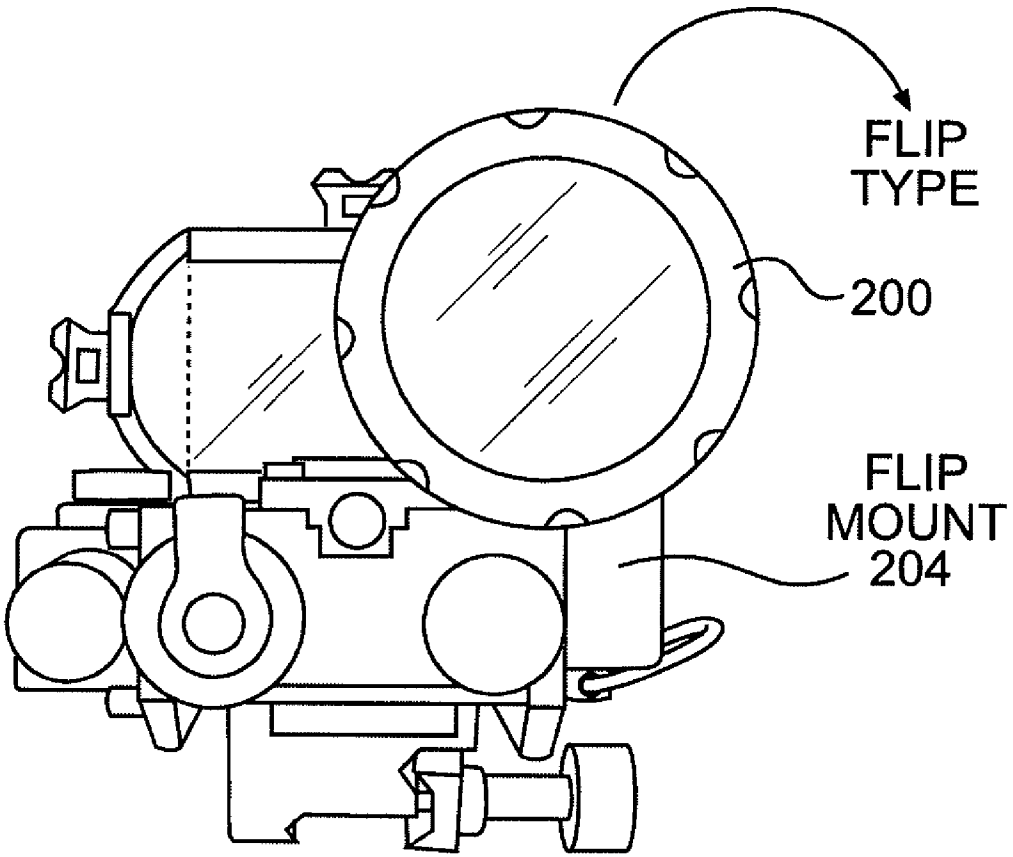
FIG. 2D shows a rear elevational view of the dot sight device with a flip type magnifier in a deployed position according to an example embodiment of the invention.
Figure 2E:
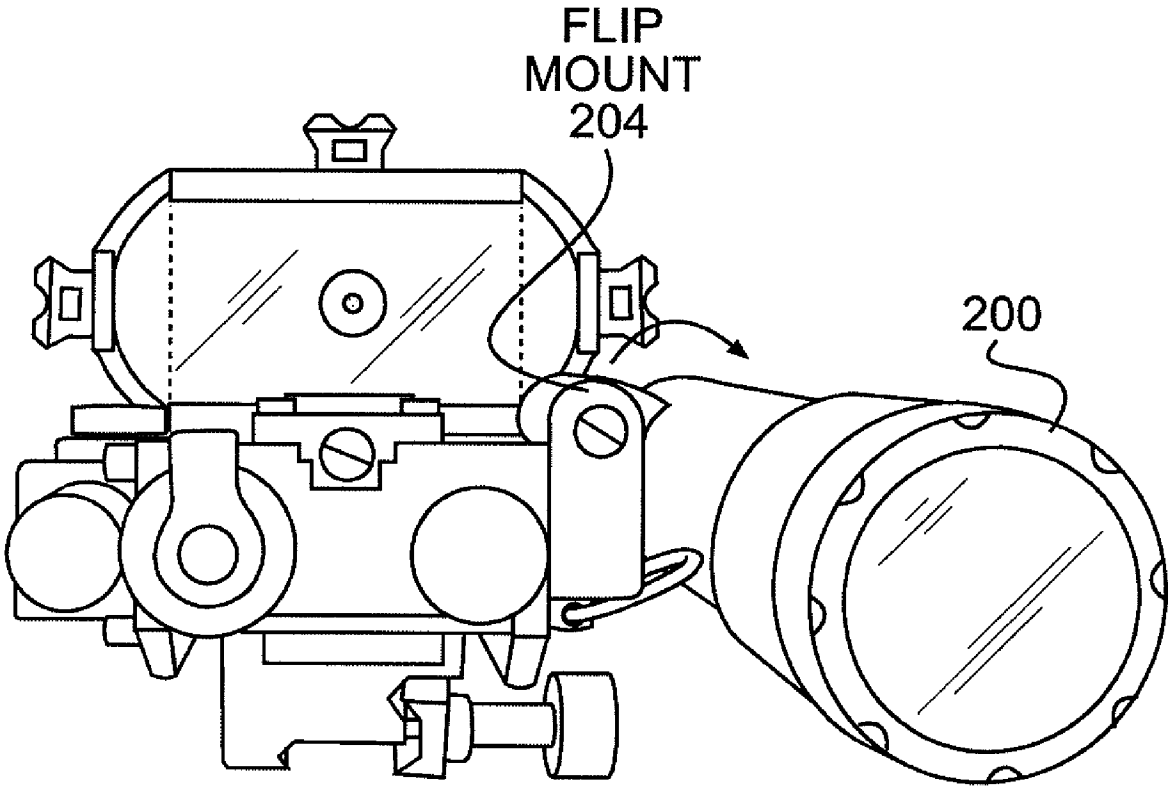
FIG. 2E shows a rear elevational view of the dot sight device with the flip type magnifier in a retracted position according to an example embodiment of the invention.

FIG. 2D shows a rear view of a dot sight device with a magnifier 200, which may be a flip type, in a deployed position according to an example embodiment of the invention. A flip mount 204 flips up or down the magnifier 200 into a deployed position or a retracted position. Additionally, as shown in FIG. 2E the flip mount 204 flips the magnifier 200 into a retracted position.

Figure 3:
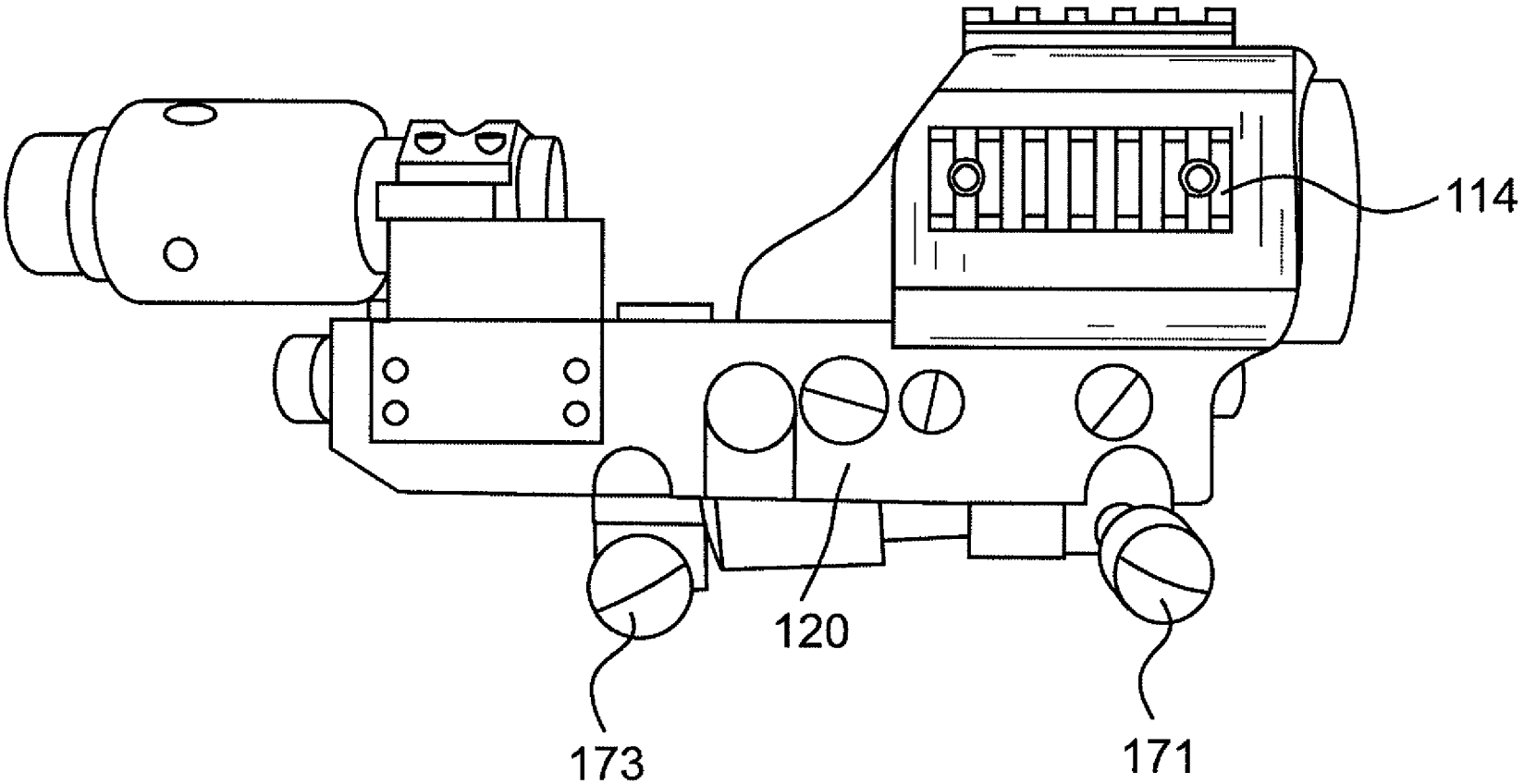
FIG. 3 shows a side view of the dot sight device according to an example embodiment of the invention.

FIG. 3 shows a side view of a dot sight device according to an example embodiment of the invention. The first bolt 171 and the second bolt 173 serves as knobs to mount the body plate 120 on an attachment device, such as a picatinny rail, attached to a firearm.

Figure 4:
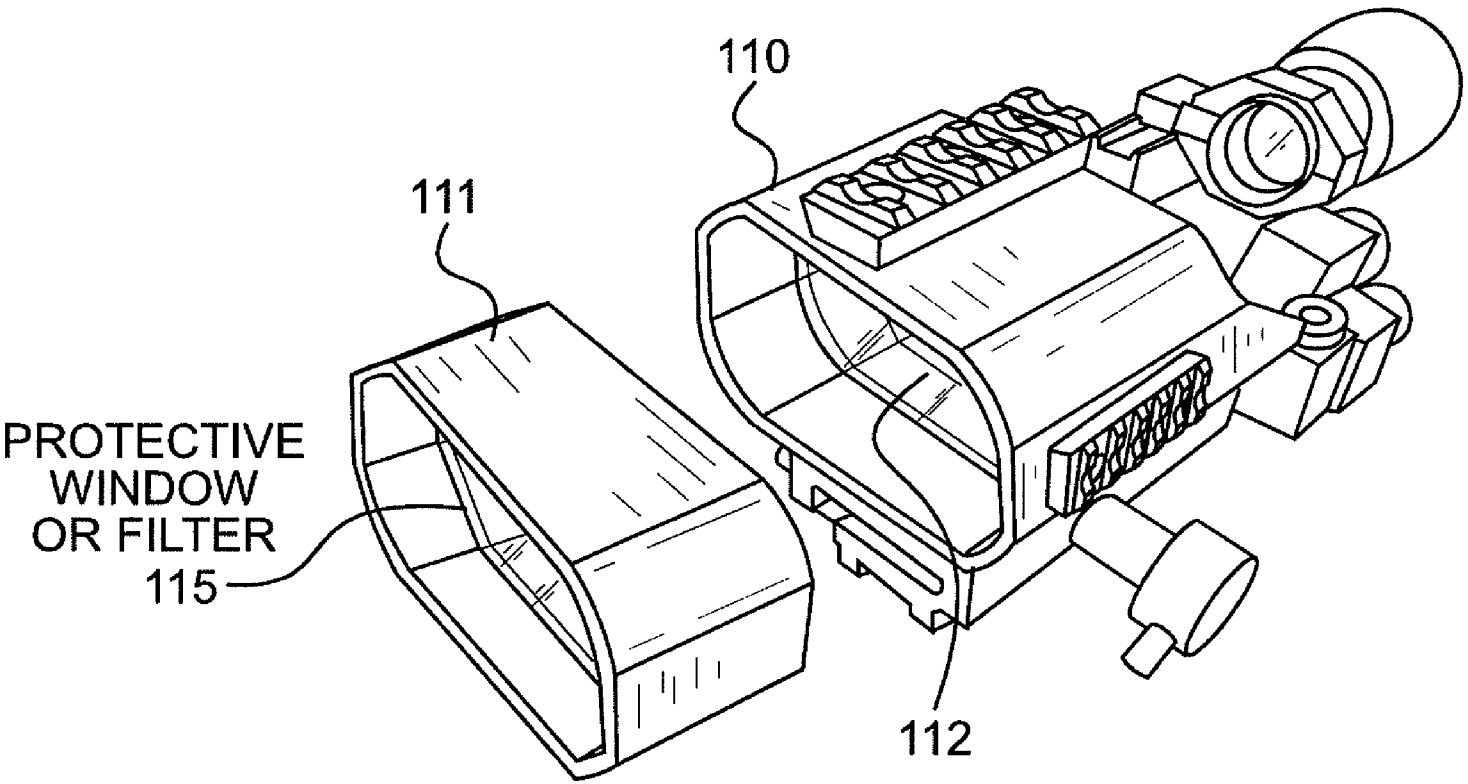
FIG. 4 shows a protective window or a filter for the dot sight device according to an example embodiment of the invention.

FIG. 4 shows a window, such as a protective window, filter or honeycomb for a dot sight device according to an example embodiment of the invention. The protective window, filter or honeycomb is by way of a window 115 surrounded by a frame 111. The protective window, filter or honeycomb is attached to the front of a dot sight device 100 by being placed into the window frame 110 to protect the transparent lens 112 and to protect users from enemy snipers. A filter or a honeycomb will reduce reflections from the transparent lens 112 and also reduce red dot brightness to thereby reduce a risk of detection.

Figure 5:
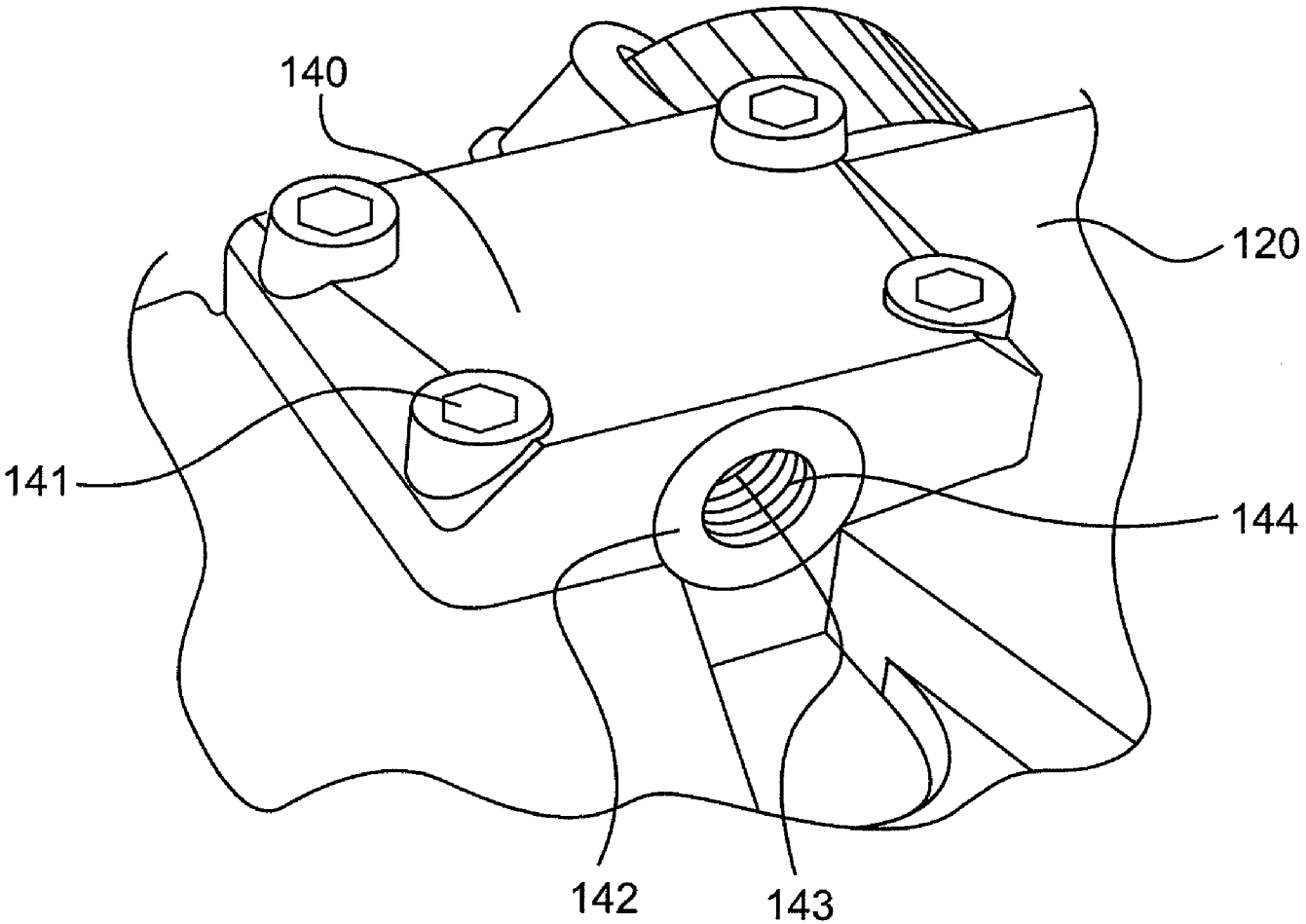
FIG. 5 shows a light emitter of the dot sight device according to an example embodiment of the invention.

FIG. 5 shows a light emitter 140 of a dot sight device according to an example embodiment of the invention. One or more bolts 141 may set the light emitter 140 onto the body plate 120. An LED 143 is placed inside an LED housing 142. The water dripped (or drip) lens 144 for the LED 143 prevents or reduces accumulation of water or other objects that may interfere with an LED light path. In embodiments of the invention, the light emitter 140 may be set onto the body place 120 by use of various attachment means or methods.

Figure 6A:
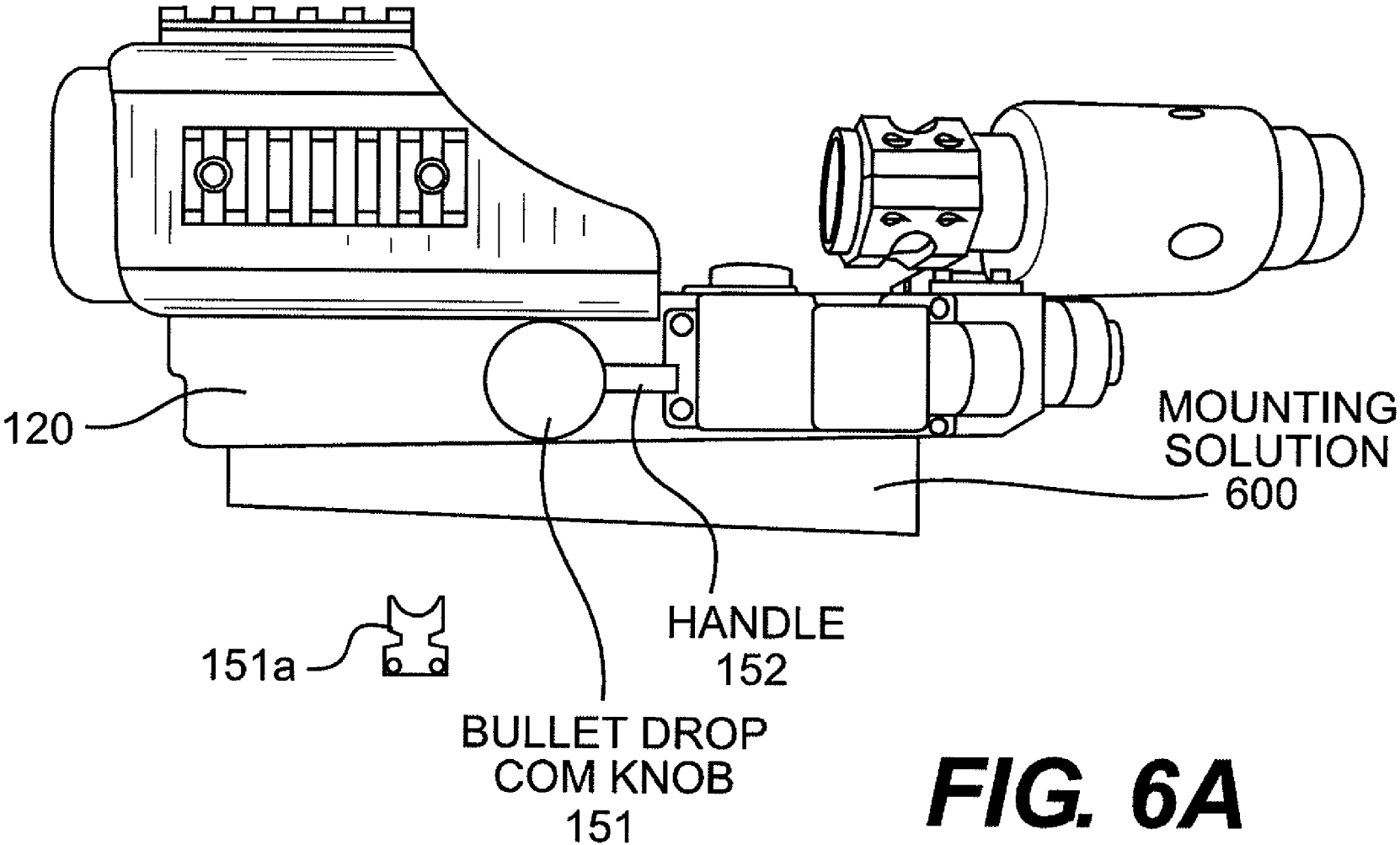
FIG. 6A shows a left side view of the dot sight device with a bullet drop compensation adapter according to an example embodiment of the invention.
Figure 6B:
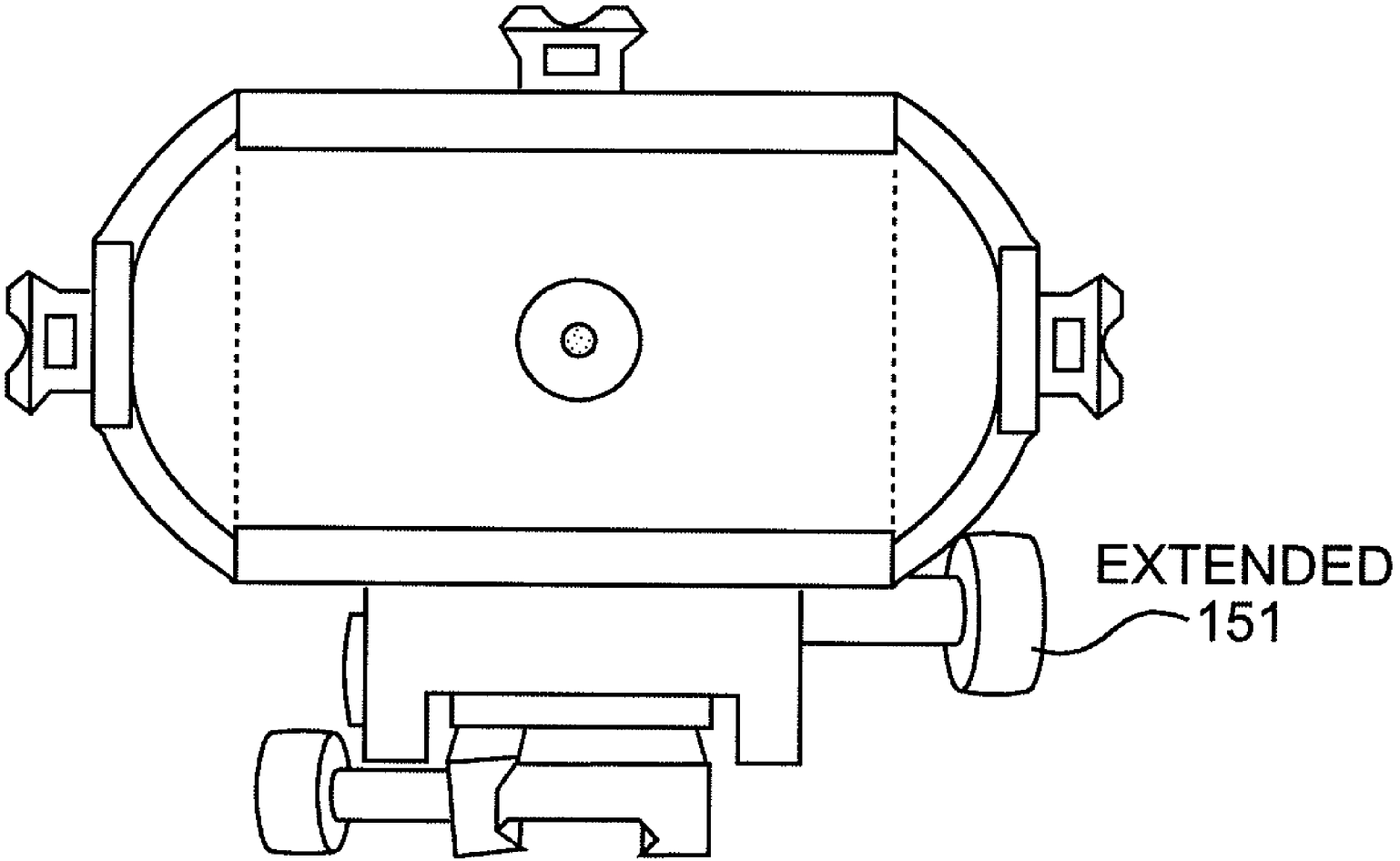
FIG. 6B shows a front side view of the dot sight device with an installed bullet drop compensation adapter on a handle side according to an example embodiment of the invention.

FIG. 6A shows a left side view of a dot sight device according to an example embodiment of the invention. The drop compensation knob 151 is configured by removing an adapter 151A, and for different calibration by movement thereof, such as pushing in for engagement with a 7.62 mm gear or pulling out for engagement with a 12.7 mm gear. In this instance, attaching the adapter 151A on the left side of the body plate 120 will calibrate for a 12.7 mm firearm. Additionally, FIG. 6B shows a front side view of a dot sight device according to an example embodiment of the invention. The bullet drop compensation knob 151 is extended due to insertion of the adapter 151A in order to allow engagement of the 12.7 mm gear. The sides of the body plate 120 to which the adapter 151A is attached is not limited to the arrangement discussed above, and can be reversed or otherwise.

Figure 6C:
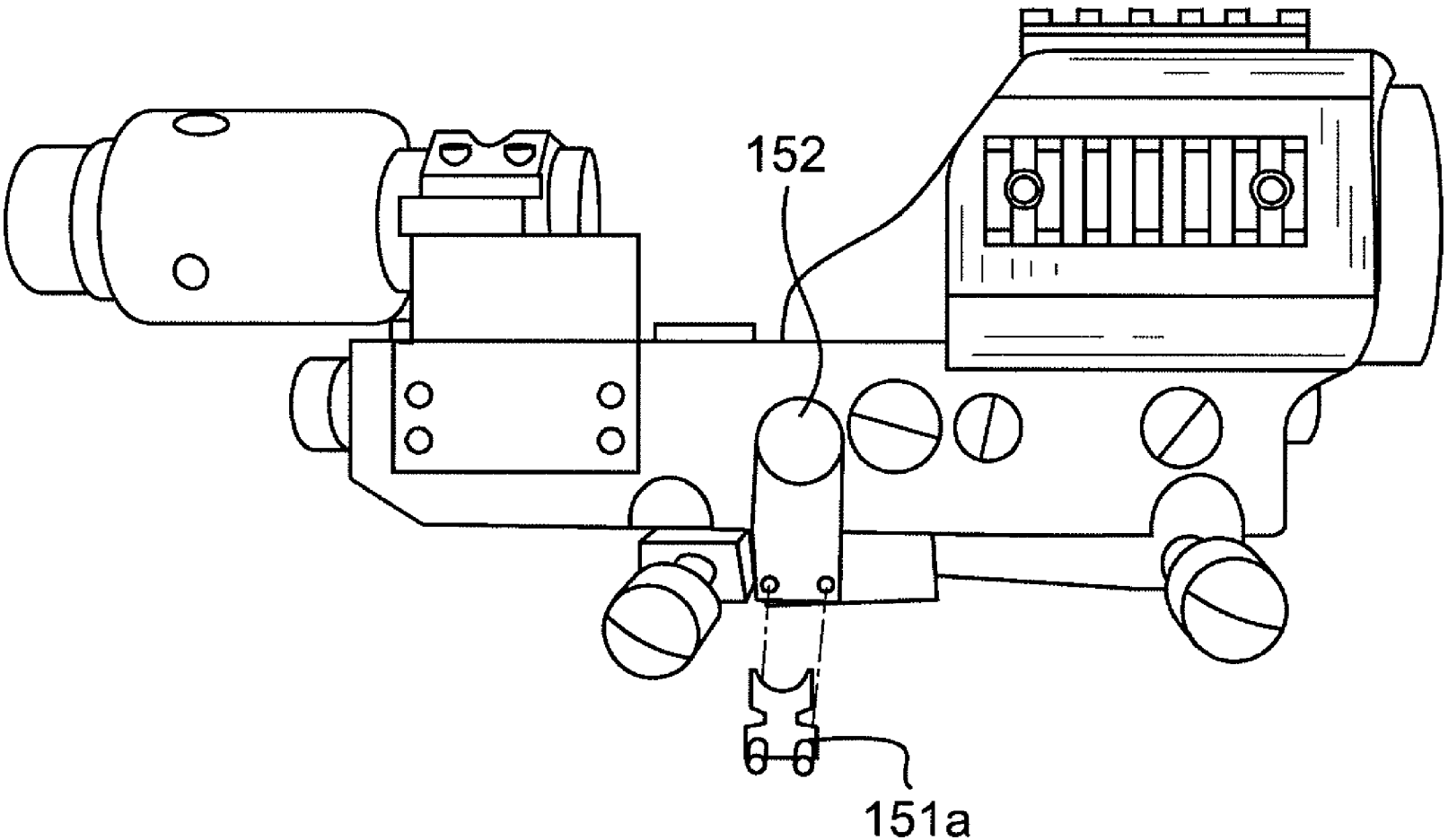
FIG. 6C shows a right side view of the dot sight device with a bullet drop compensation adapter according to an example embodiment of the invention.

FIG. 6C shows a right side view of a dot sight device according to an example embodiment of the invention. The bullet drop compensation knob 151 is contracted due to removal of the adapter 151A in order to allow engagement of the 7.62 mm gear. The ring 152 will allow for inserting and securing of the adapter installation.

Figure 6D:
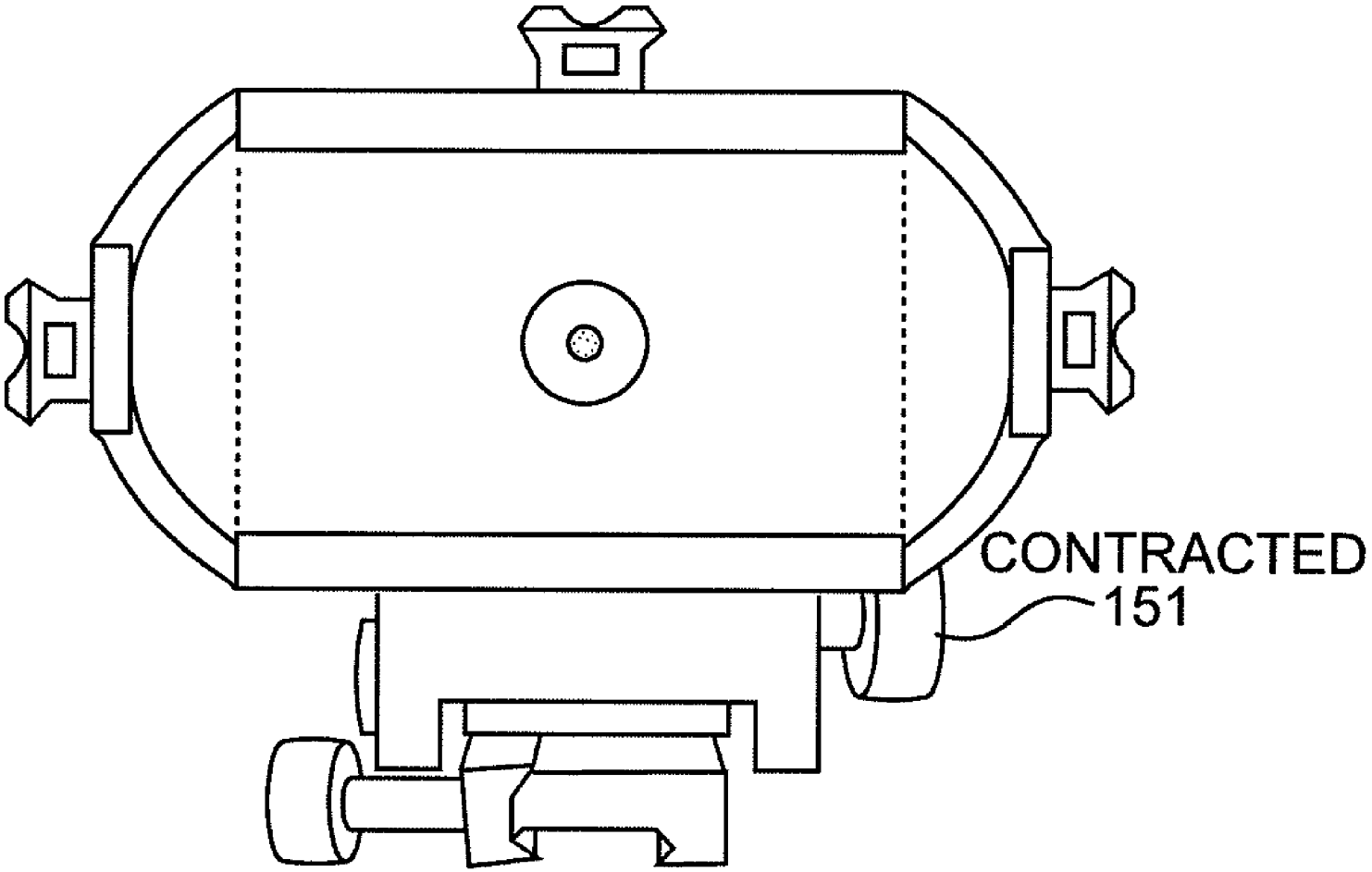
FIG. 6D shows a front side view of the dot sight device (Octagonal lens) with an installed bullet drop compensation adapter on an opposite of handle side according to an example embodiment of the invention.

Additionally, FIG. 6D shows a front side view of a dot sight device according to an example embodiment of the invention. The bullet drop compensation knob 151 is shown contracted which allows engagement of the 7.62 mm gear.

Figure 6E:
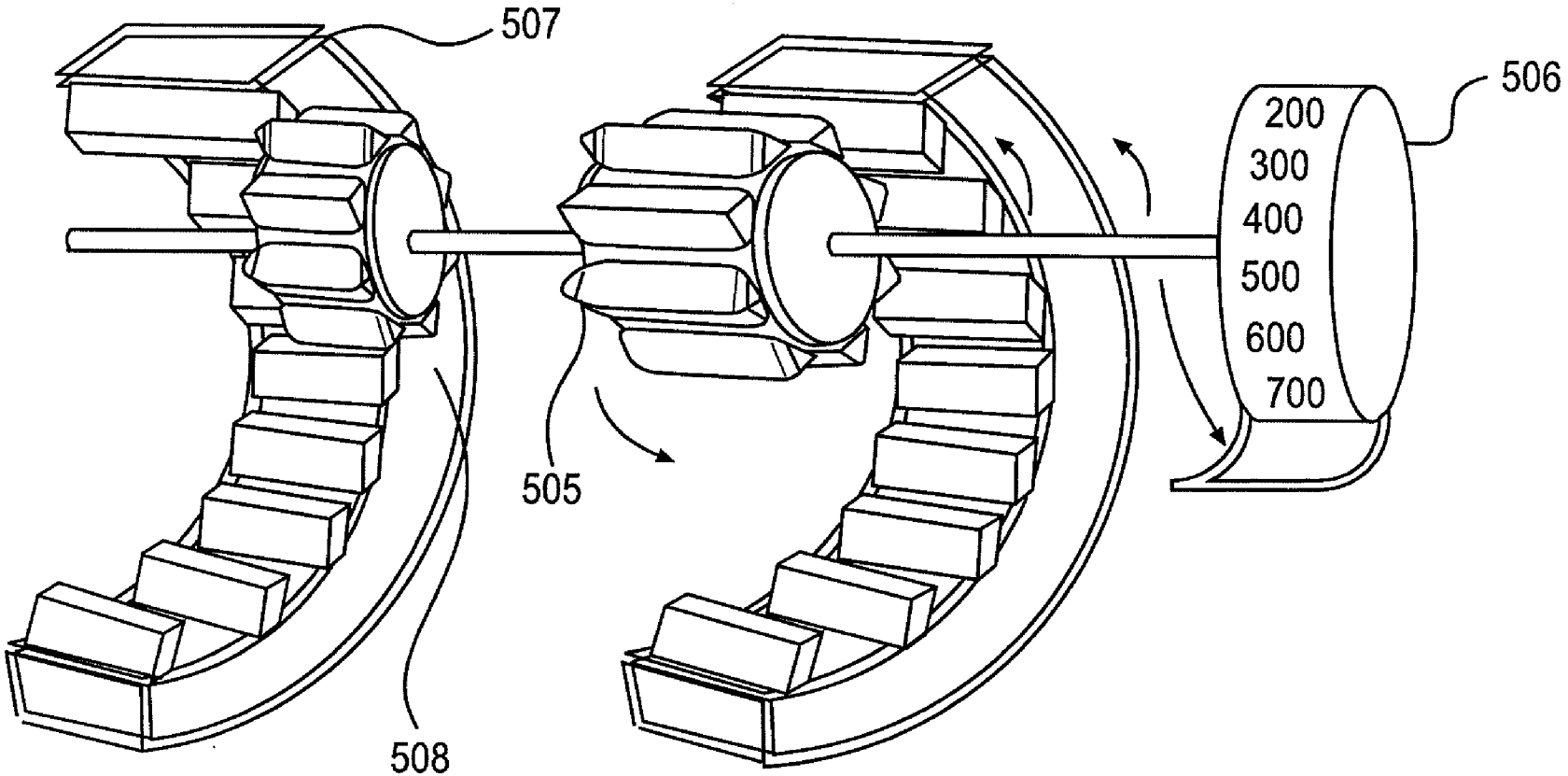
FIG. 6E depicts an inside view of a dual ballistic gear with a 12.7 mm gear engaged according to an example embodiment of the invention.
Figure 6F:
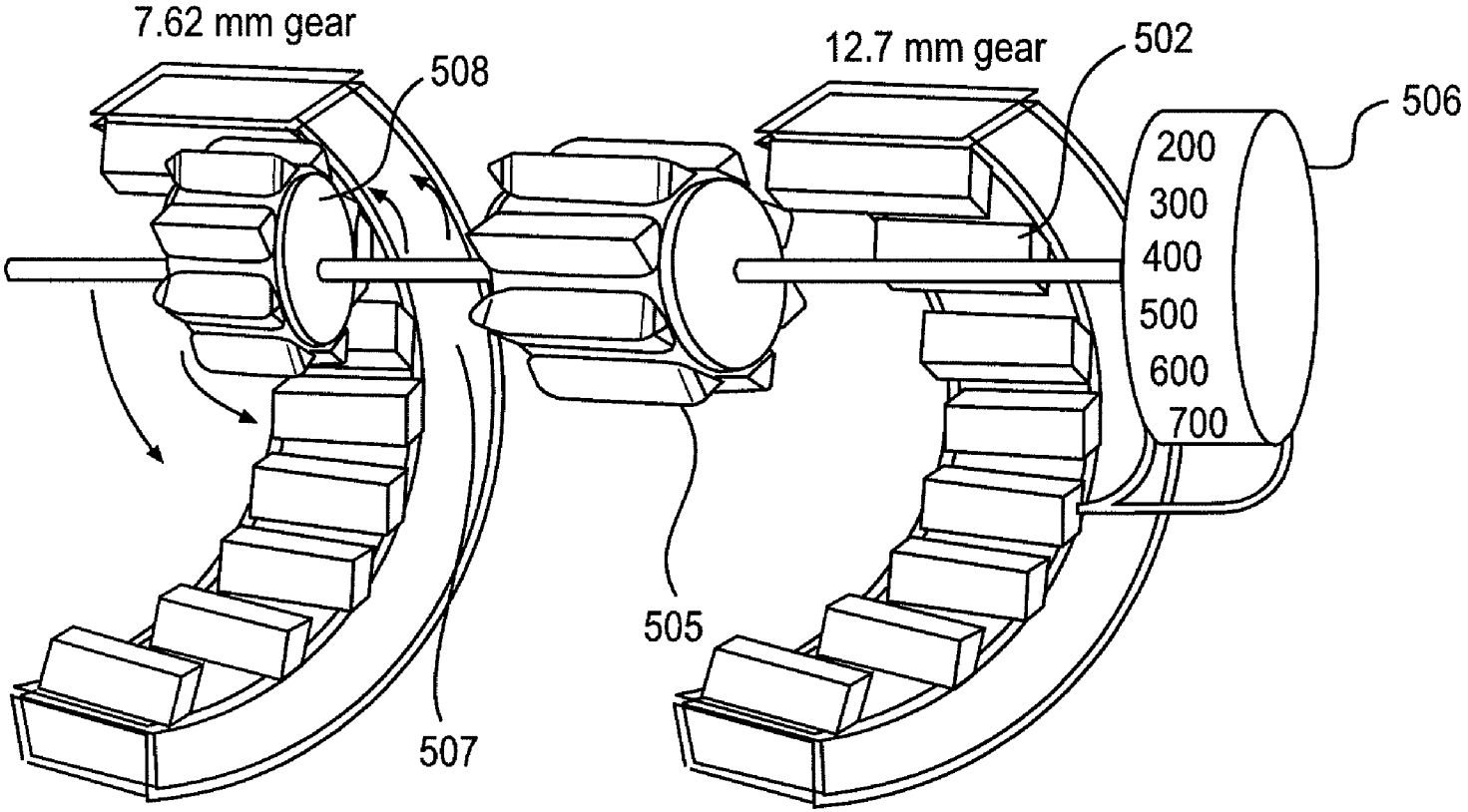
FIG. 6F depicts an inside view of a dual ballistic gear with a 7.62 mm gear engaged according to an example embodiment of the invention.

FIG. 6E and FIG. 6F show a concept of dual ballistics of a dot sight device 100 according to an example embodiment of the invention. As shown in FIG. 6E, the 12.7 mm gear 505 is engaged on the 12.7 mm track 502 to adjust according to the ballistics of a 12.7 mm firearm. Turning the dual ballistic trajectory knob 506 will allow a shooter to adjust a bullet drop compensation in 100 m increments or any increments from 200-2000 m. Additionally, shown in FIG. 6F is the 7.62 mm gear 508 engaged on the 7.62 mm track to adjust according the ballistics of a 7.62 mm firearm. The dual ballistic trajectory knob 506 may be marked with distances in meters, for example.

Figure 7A:
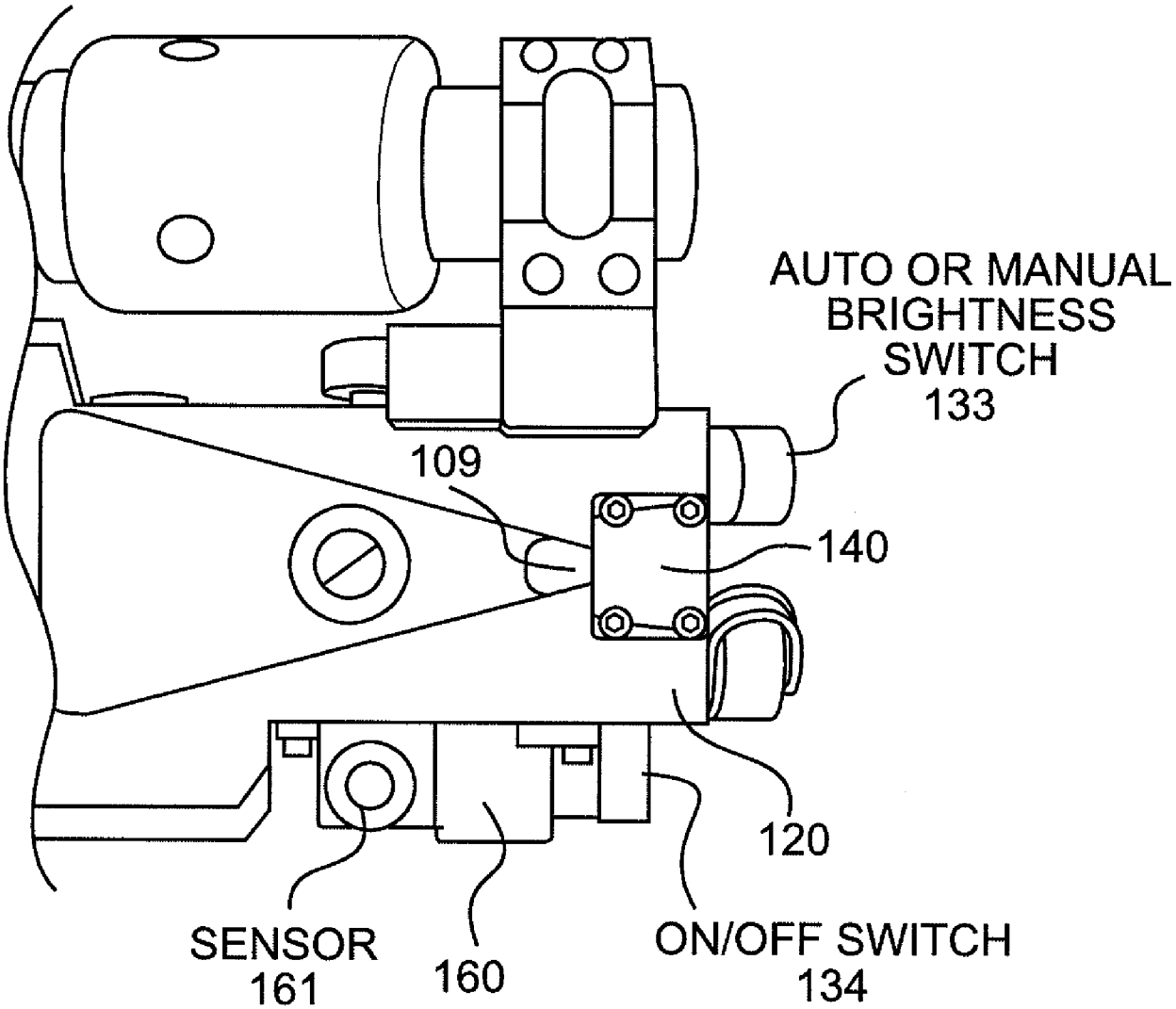
FIG. 7A shows a top view of a drain of the dot sight device according to an example embodiment of the invention.

FIG. 7A shows a top view of a drain of a dot sight device according to an example embodiment of the invention. The drainage hole 109 is located in front of the light emitter 140. The auto or manual brightness switch 133 is located to the right of the light emitter 140. The automatic brightness detector 160 is located to the left of the light emitter 140 and placed on a left side wall of the body plate 120. The automatic brightness detector 160 is coupled to a sensor 161 and an on/off switch (a brightness detector switch) 134, among others. Accordingly, the automatic brightness detector, when turned on by the on/off switch 134, can automatically control the brightness of the dot or shape (or a pattern) depending on an amount of ambient light or based on whether the time is night or day. Additionally, the on/off switch 134 may be used to turn off the automatic brightness detector 160, so that the brightness switch 133 is then used to manually adjust the brightness of the dot or shape based on the shooter's preference.

Figure 7B:
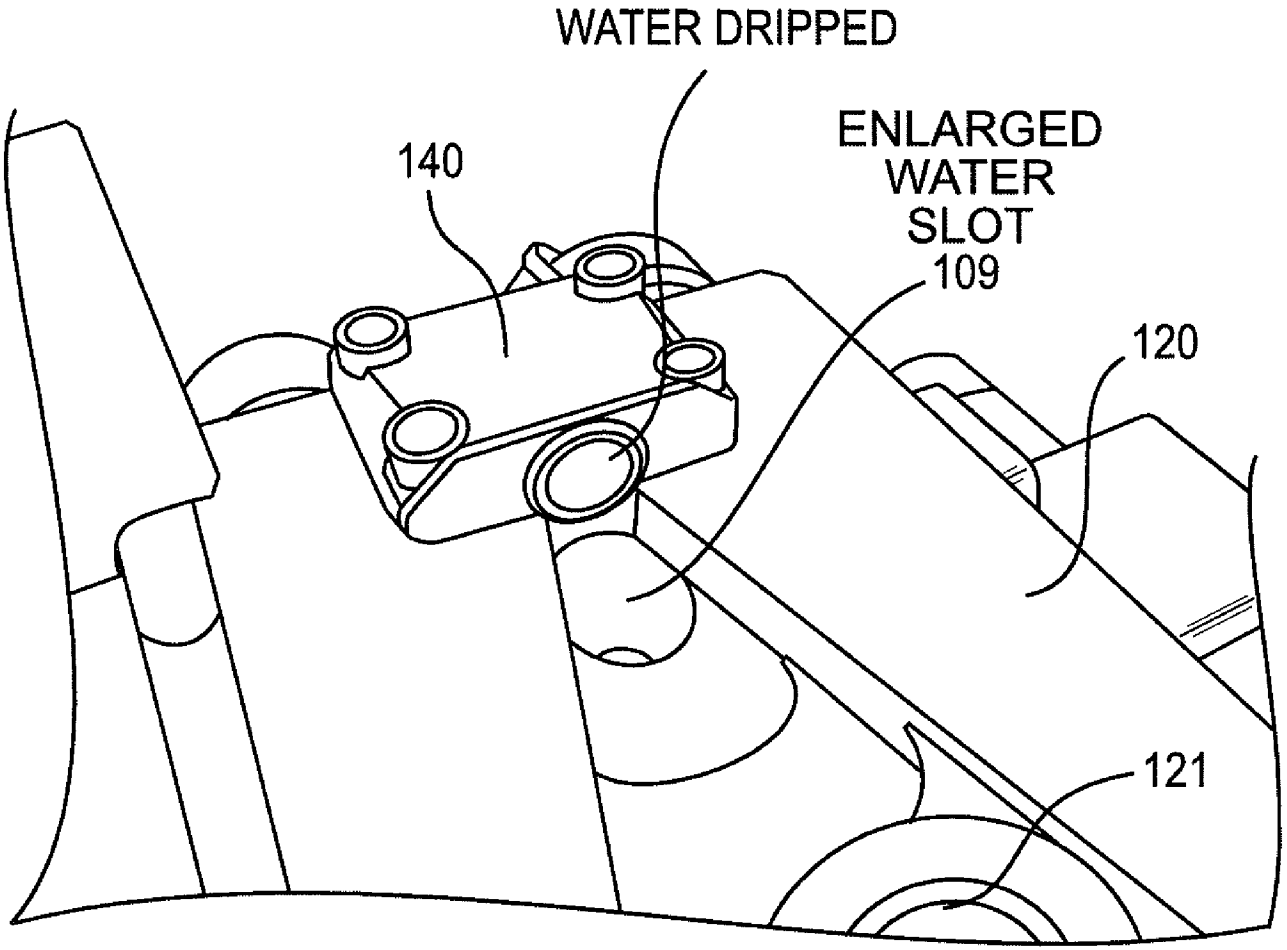
FIG. 7B shows a magnified view of the drain of the dot sight device according to an example embodiment of the invention.

FIG. 7B shows a magnified view of the drain of a sighting device according to an example embodiment of the invention. The drainage hole (or enlarged water slot) 109 is placed in the body plate 120 in front of the light emitter 140. The water dripped (or drip) lens 144, drainage hole (enlarged water slot) 109, and the elevation control knob 121 may be collinear, but may also be offset.

Figure 8:
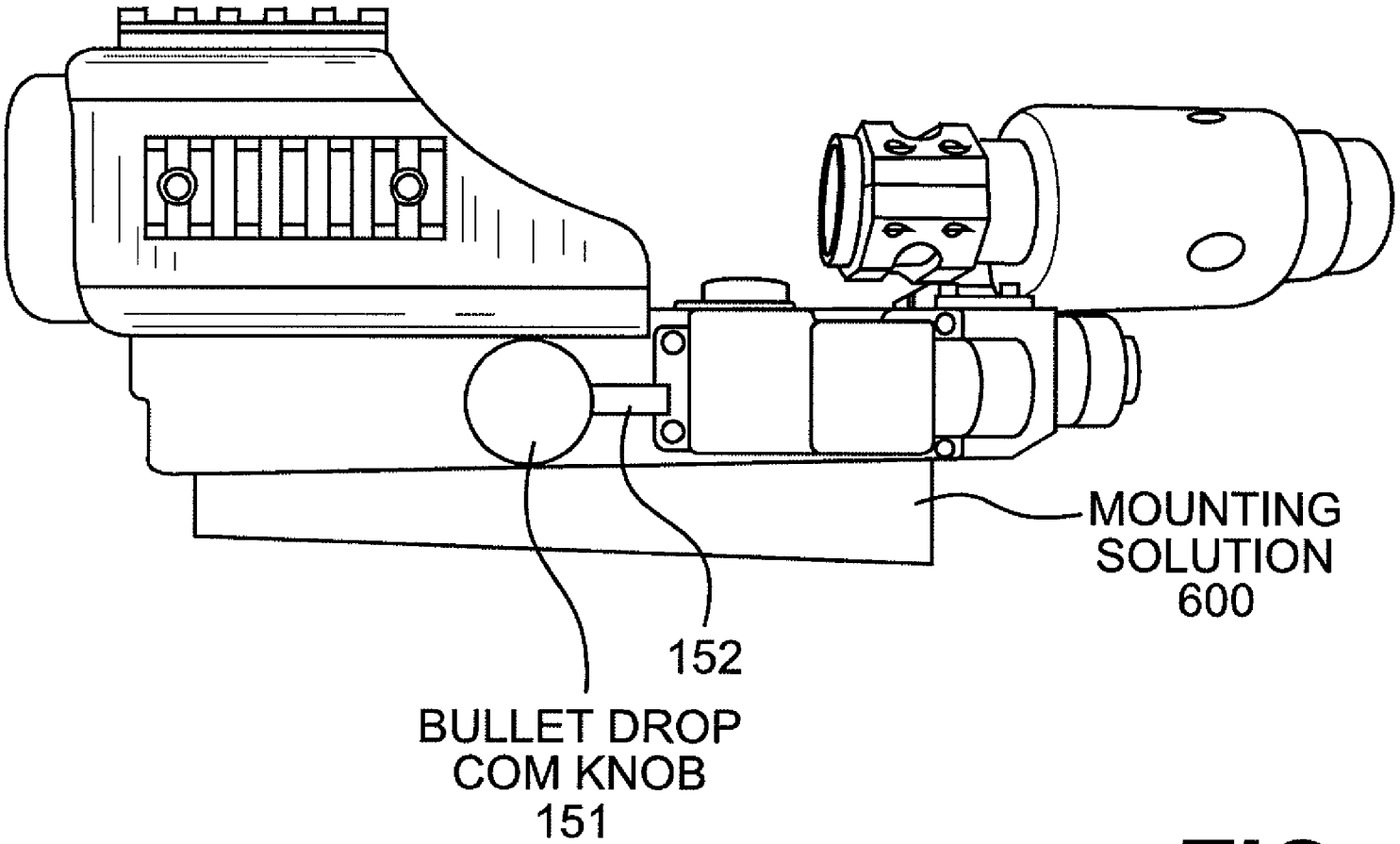
FIG. 8 shows a view of an elevation control knob of the dot sight device according to an example embodiment of the invention.

FIG. 8 shows a view of a bullet drop compensation knob of a dot sight device according to an example embodiment of the invention. The handle 152 turns the bullet drop compensation knob 151 that allows the shooter to adjust for various trajectories (200-2000 m). There is a stopper at 2000 m to prevent the bullet drop compensation knob from turning to directly to 200 m. In embodiments of the invention, a distance less than 200 m and a distance greater than 2000 m may also be used.

Figure 9:
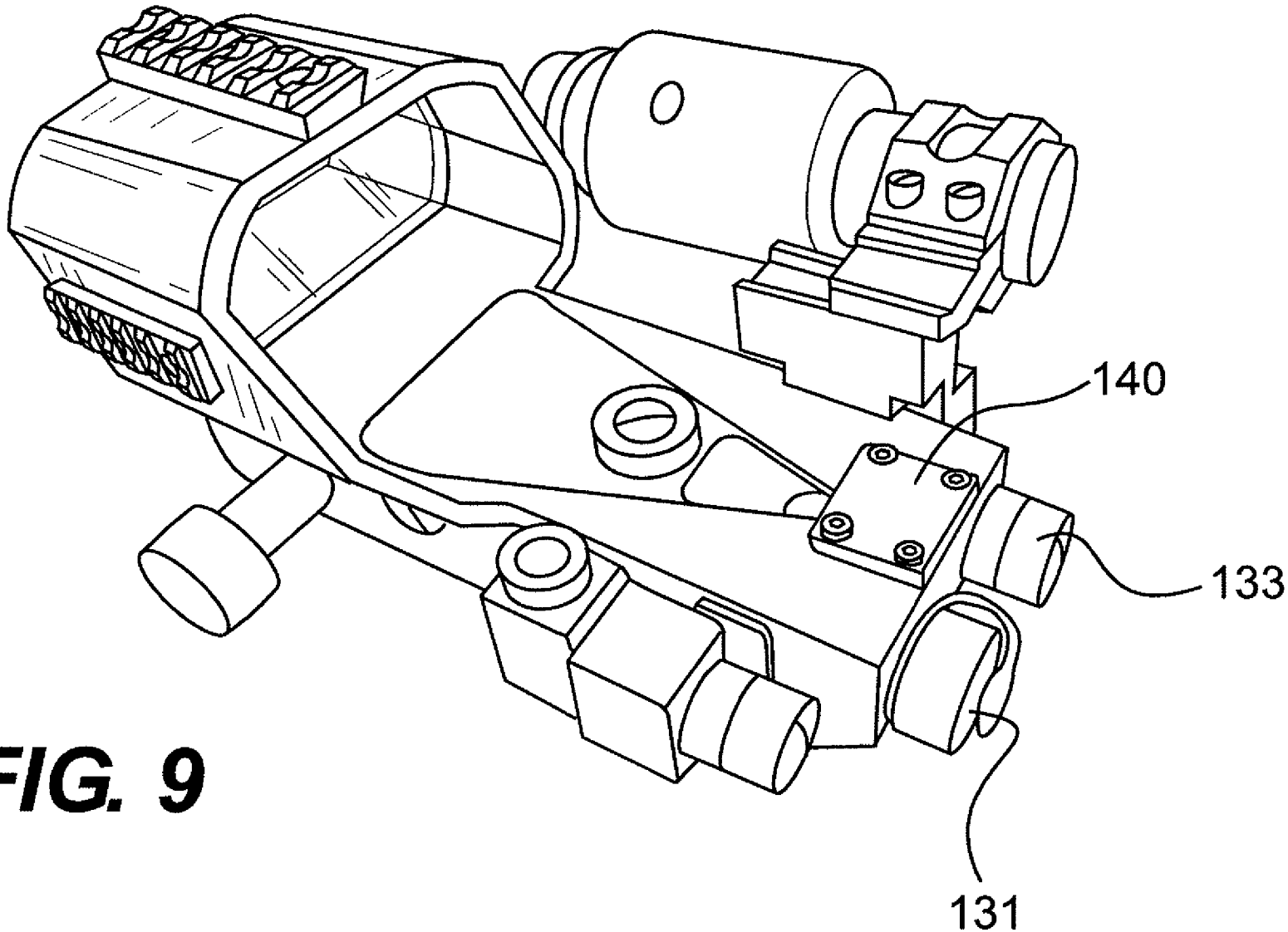
FIG. 9 shows a view of a battery cap of the dot sight device according to an example embodiment of the invention.

FIG. 9 shows a view of a battery cap with a holder of a dot sight device according to an example embodiment of the invention. The battery case 131 is on the left of the light emitter 140 on the back edge of the body plate 120. The auto or manual brightness switch 133 is on the right of the light emitter 140 on the back edge of the body plate 120. The arrangement of the battery case 131 and the auto or manual brightness switch 133 may be different.

FIG. 10A shows another top plan view of a dot sighting device according an example embodiment of the invention. The light emitter 140, the drainage hole 109, which is enlarged, and the elevation control knob 121 may be collinear, but could also be offset. The light emitter 140 is located at the back end of the body plate 120 and the drainage hole 109 is immediate in front of the light emitter 140. The bullet drop compensation knob 151 is located on the side of the body plate 120, beneath the window frame 110. In this instance, the window frame 110 supports a top rail 113 and a side rail 114. The bullet drop compensation knob 151 is used to operate a bullet drop compensation device.

FIG. 10B shows a left side view of a dot sight device with a bullet drop compensation device according to an example embodiment of the invention. The bullet drop compensation device may be various types, including a scissor type and a gear type.

FIG. 10C depicts an inside view of a scissor type bullet drop compensation device of a dot sight device according to another example embodiment of the invention. The scissor type bullet drop compensation device 500 includes a mounting solution 600 beneath the body plate 120 and a scissor jack 501 located between the body plate 120 and mounting solution 600. A scissor jack handle 501A adjusts the height thereof allowing the dot sight device to adjust for different trajectories (200-2000 m), and a pin 503 holds together the mount solution 600 and the body plate 120.

FIG. 10D shows a gear type bullet drop compensation device 800 of a dot sight device according to another example embodiment of the invention. In the gear type bullet drop compensation device 800, the bullet drop compensation knob 151 is located on the left side of the body plate 120 and moves a trajectory gear track 802 up and down using a gear 805. The trajectory gear track 802 is fixed onto the body plate 120. Again, the pin 503 holds the mounting solution 600 and the body plate 120 as a pivot point. As shown in FIG. 10E and in greater detail, the gear type bullet drop compensation device 800 moves the body plate 120 by a rotation of the gear 805 against the gear track 802. The bullet drop compensation knob 151 is attached to the mounting solution 600.

FIG. 10F shows a movable LED emitter device 700, which acts as a movable light emitter type bullet drop compensation device of the dot sight device according to another example embodiment of the invention. The movable light emitting module 701 includes a gear 704, an LED 703, an LED housing 702 and an LED lens protector 705. The LED housing 702 is located inside the movable light emitting module 701. The angle of the LED light may be adjusted by the shooter by adjusting (e.g., up and down) the LED housing 702 by way of turning of the gear 704. The LED 703 located inside the LED housing 702 is protected by the LED lens protector 705. The LED 703 and the LED housing 702 may pivot relative to a fixed part based on the turning of the gear 704.

FIG. 10G shows a range finder 1200 for a dot sighting device according to an example embodiment of the invention. The range finder 1200 may be used in automating the dot sighting device. For example, the distance to a target is measured by the laser range finder 1200 located on the left side of the window frame 110. The information about the distance is then transferred to the LED housing 702, and by rotating the gear 704 based on the distance information, the LED 703 is controlled for a proper bullet drop compensation. Information about targets will be displayed on transparent lens 112.

Figure 11:
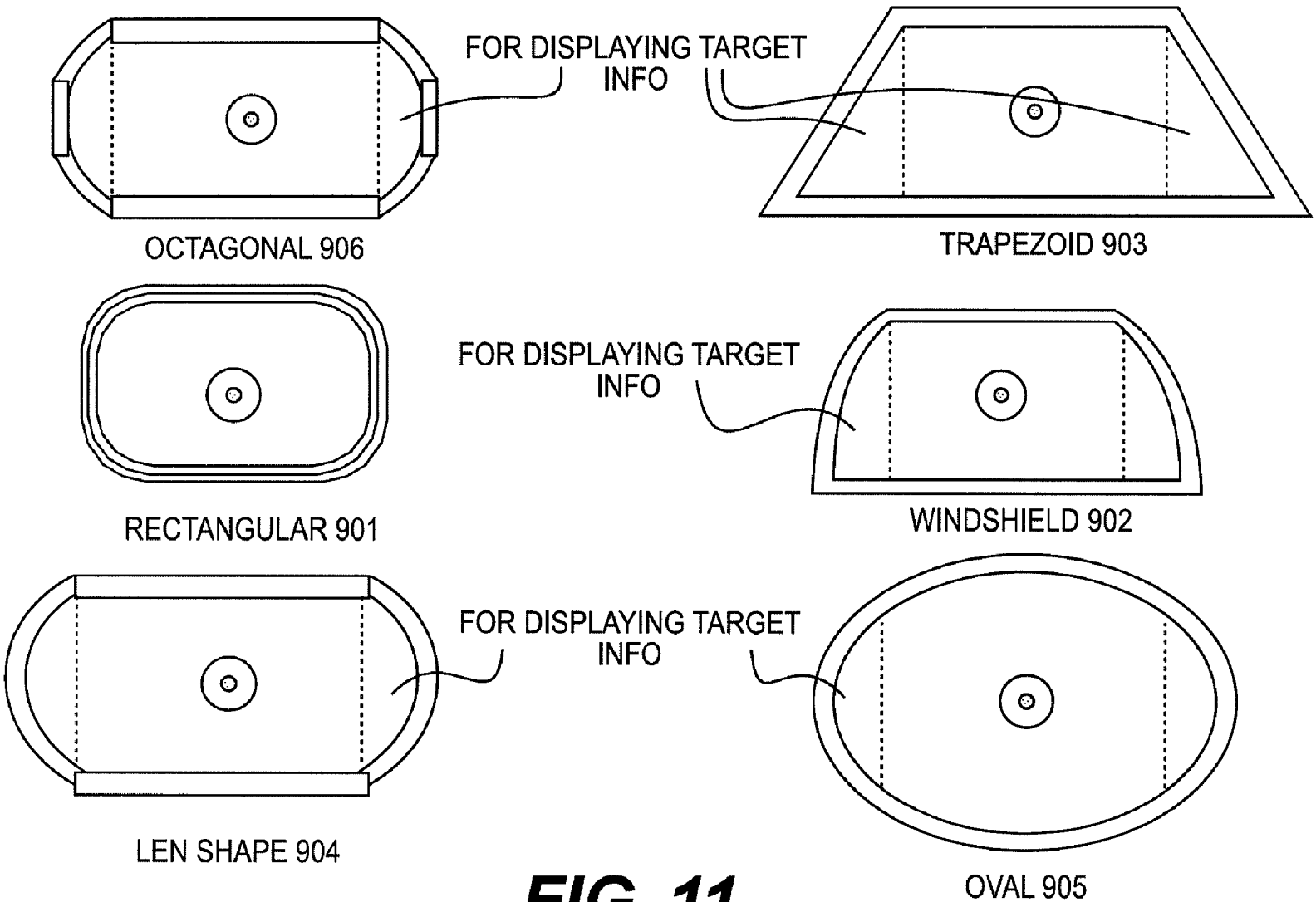
FIG. 11 shows different lens shapes and sizes of the dot sight device according to an example embodiment of the invention.

FIG. 11 shows various lens shapes and sizes for a dot sight device according to an example embodiment of the invention. The rectangular shape 901, windshield shape 902, trapezoid shape 903, lens shaped 904, oval shape 905 and octagonal shape 906, include additional room on each side to display target information. For example, data such as the distance from the laser range finder 1200, wind, elevation, and other necessary data to enhance the shooter's precision can be displayed on the transparent lens 112, such as on the sides (e.g., left or right), as target information. In embodiments of the invention, the target information may be displayed anywhere on the transparent lens 112.

Figure 12A:
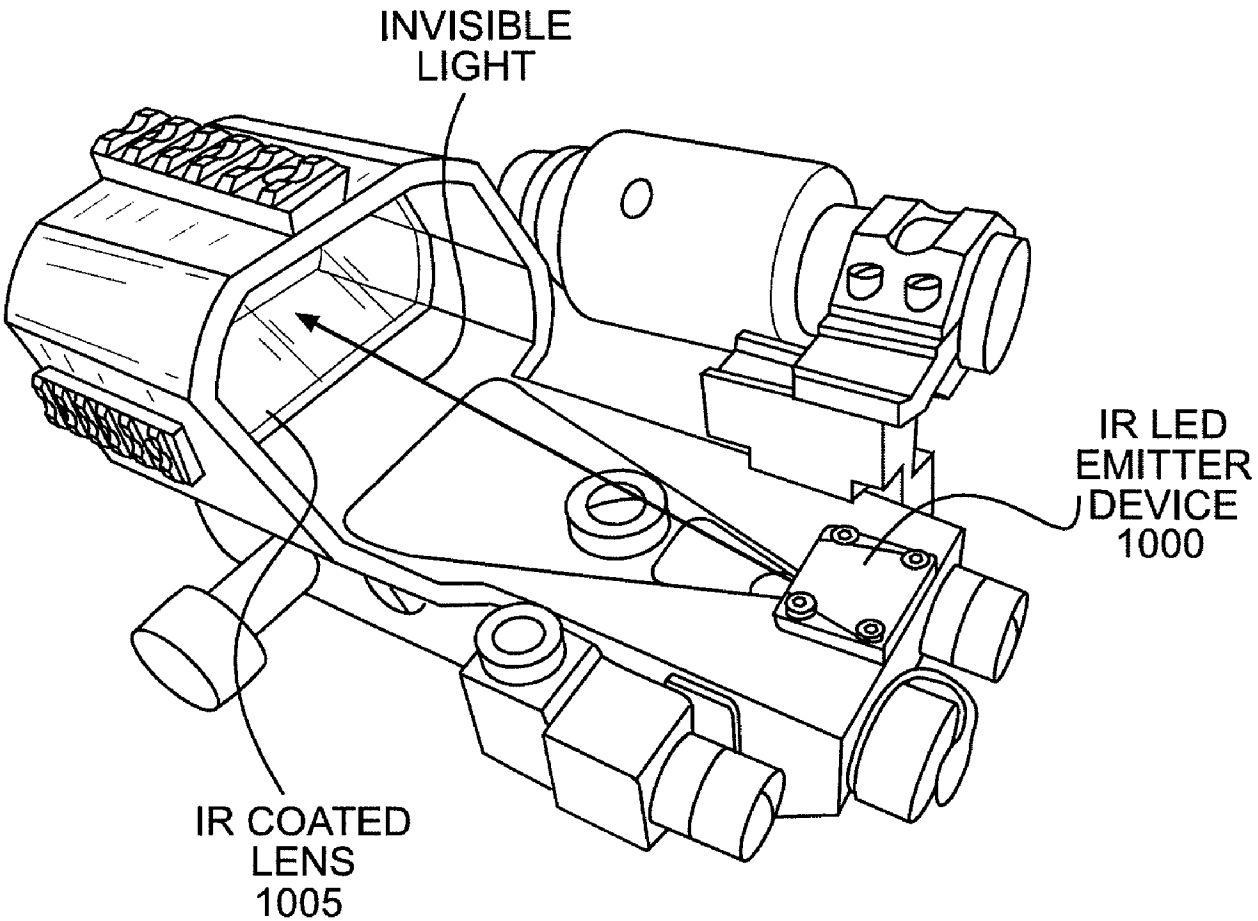
FIG. 12A shows an IR LED emitter device with an IR coated lens of the dot sight device according to an example embodiment of the invention.

FIG. 12A shows an IR LED emitter device for a dot sight device (IR dot sight) according to an example embodiment of the invention. A movable IR LED emitter device 1000 emits IR or infrared light that is invisible to the human eye. Once the IR light emitted from the movable IR LED emitter device 1000 reaches a coated lens 1005, such as an IR coated lens, it is then converted into visible light (red, green or other color) for the shooter's viewing purposes. The IR Dot Sight will better protect a shooter from disclosing the shooter's position to enemies compared to red light generated from an LED emitter device. The IR coated lens 1005 is coated with a material that converts IR light into visible light of at least one color.

Figure 12B:
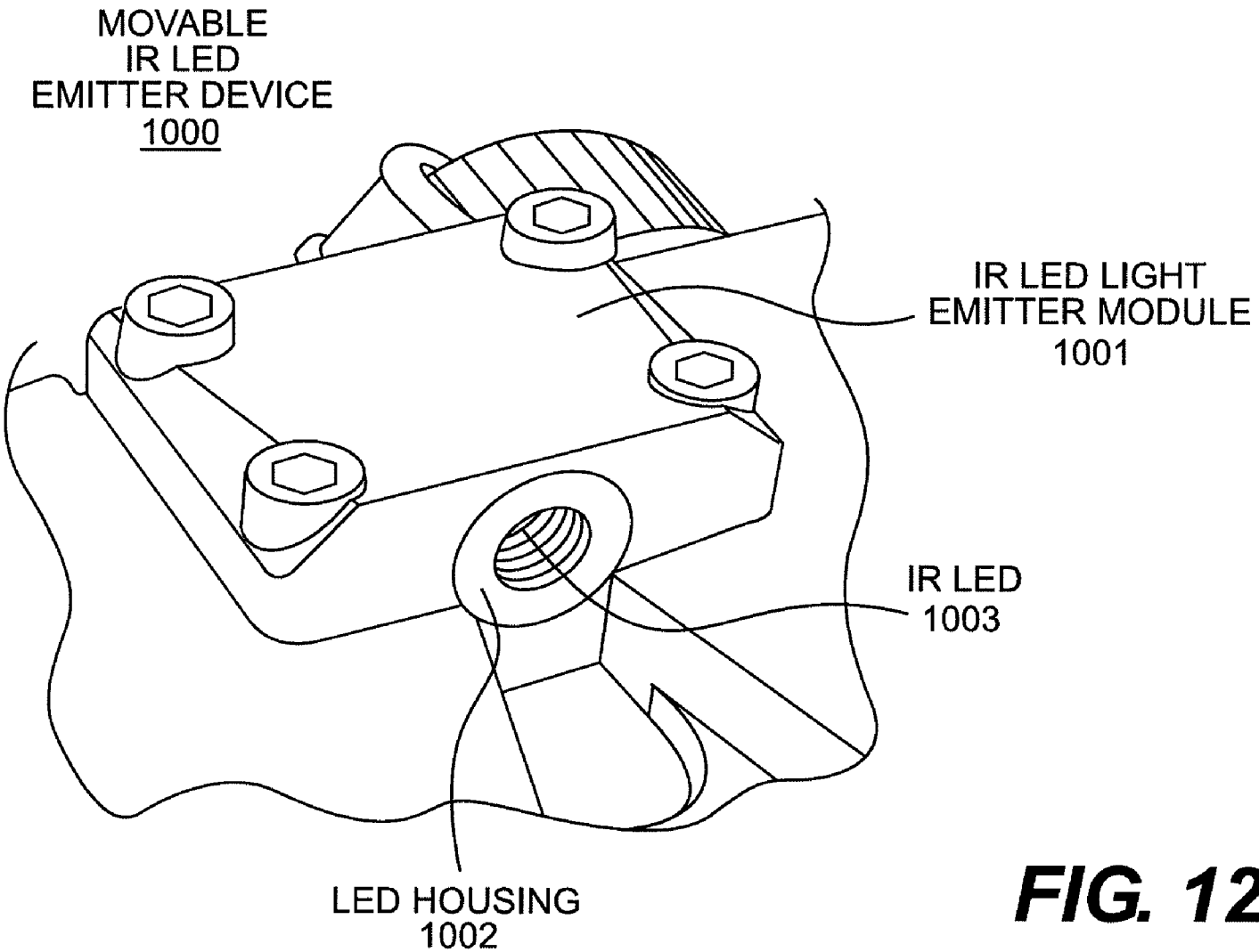
FIG. 12B shows a magnified view of an IR LED emitter device with a IR coated lens of the dot sight device according to an example embodiment of the invention.

As shown in FIG. 12B and in greater detail, the movable IR LED emitter device 1000 includes an IR LED housing 1002 located inside the IR LED light emitter module 1001 that protects IR LED 1003. The IR LED 1003 projects IR light. The IR LED Light emitting module comes with a movable LED housing 1002 for an easy bullet drop compensation from 200-2000 m in a similar manner as discussed with reference to FIGS. 10F and 10G.

Figure 13:
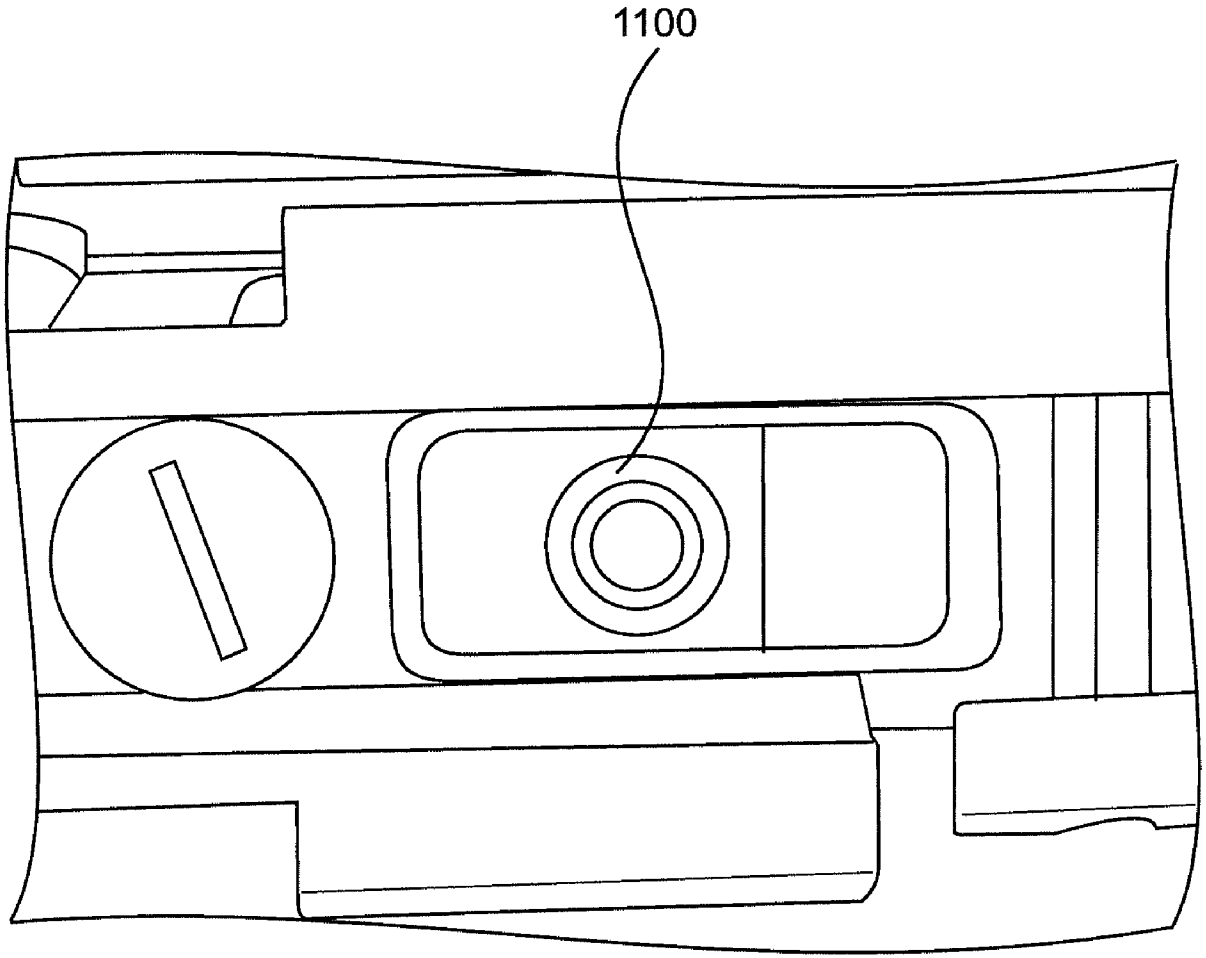
FIG. 13 shows a bottom view of the dot sight device with the elevation control knob stopper according to an example embodiment of the invention.

FIG. 13 shows a bottom view a dot sight device for the elevation stopper 1100 according to an example embodiment of the invention. The elevation stopper 1100 provides limited turning of the elevation control knob 121 to prevent the elevation control knob 121 from separating from the body plate 120.

In embodiments of the invention, various rails 113, 114 and 116 enable a shooter to install other devices such as laser pointers, illuminators (flashlights), laser range finders, night vision devices, thermal cameras or others.

Hereinafter, other example embodiments of this invention will be described in detail with reference to FIGS. 14-24. Like reference numerals designate like elements throughout the specification.

Figure 14:
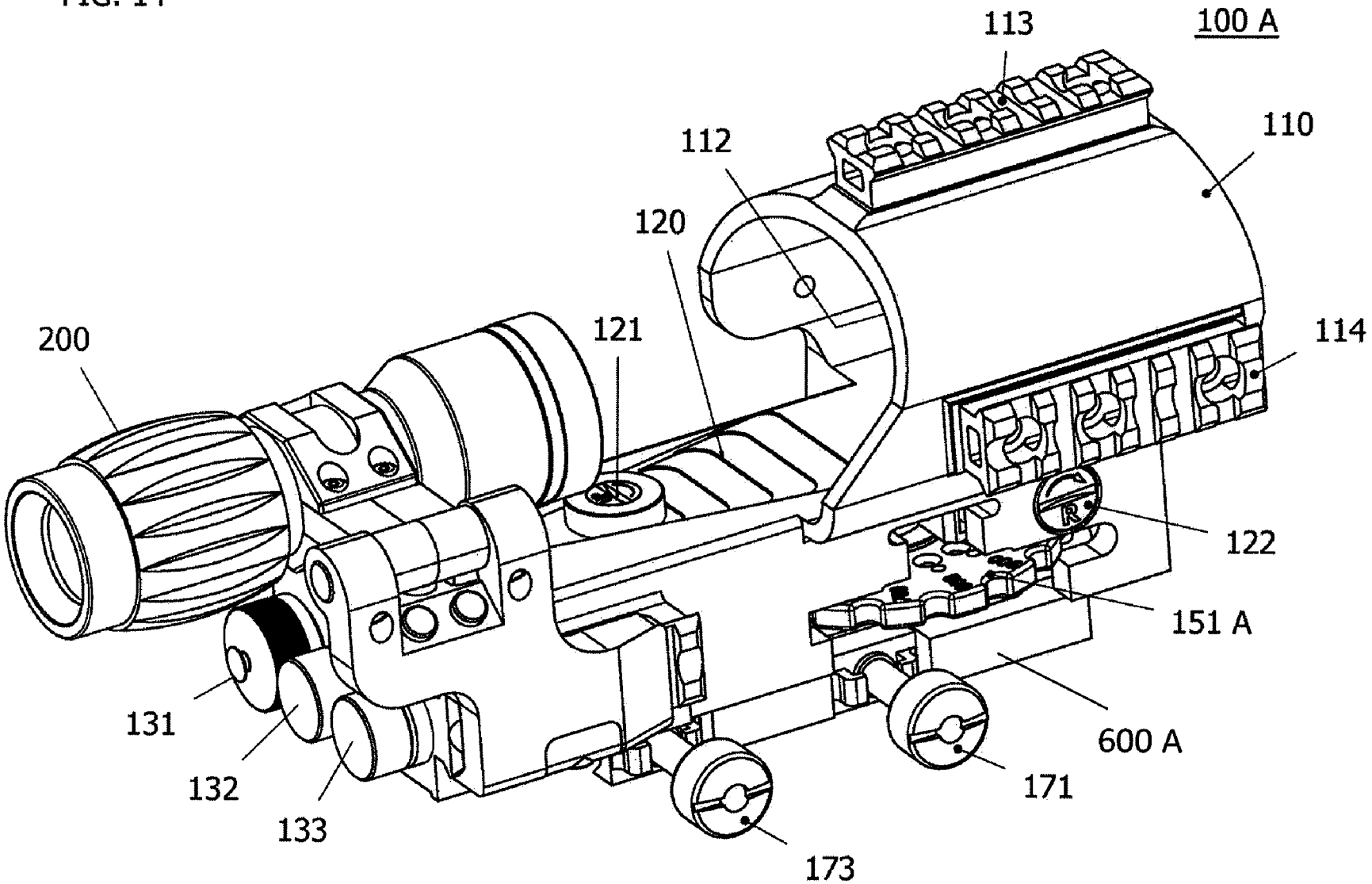
FIG. 14 shows a right-side perspective view of the dot sight device according to an example embodiment of the invention.
Figure 15A:
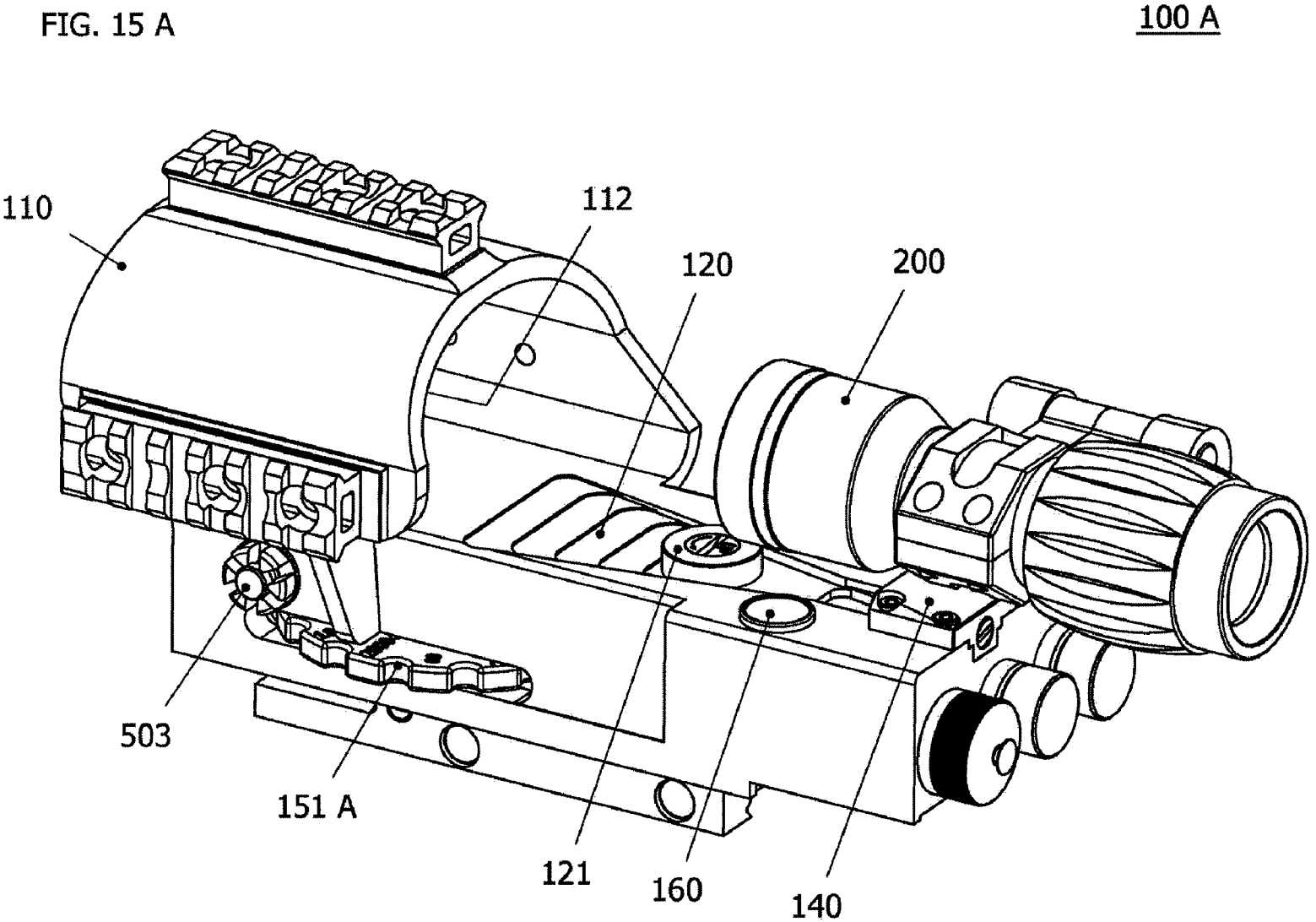
FIG. 15A shows a first left-side perspective view of the dot sight device according to an example embodiment of the invention.
Figure 15B:
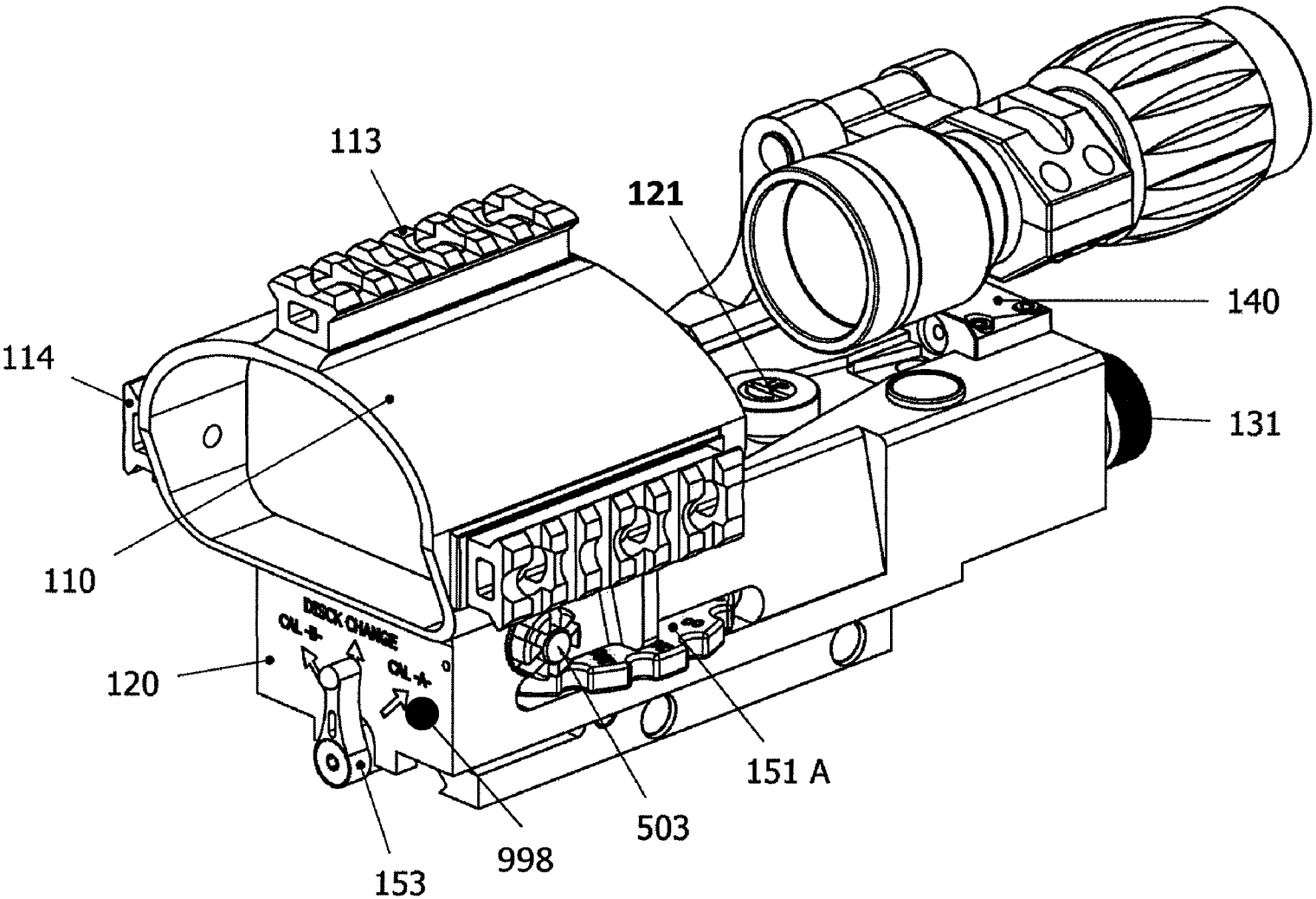
FIG. 15B shows a second left-side perspective view of the dot sight device according to an example embodiment of the invention.

FIG. 14 shows a right-side perspective view of the dot sight device according to an example embodiment of the invention. FIG. 15A shows a first left-side perspective view of the dot sight device according to an example embodiment of the invention. FIG. 15B shows a second left-side perspective view of the dot sight device according to an example embodiment of the invention.

As shown in FIG. 14 in greater detail a dot sight device 100A according to an example embodiment of the invention generally includes a window frame 110, a body plate 120, optional devices such as a magnifier 200 and a laser range finder 1200 (see FIG. 10G, for example). The window frame 110 supports a transparent lens 112, and the body plate 120 supports a mounting solution 600 A with a first bolt 171 and a second bolt 173 used in attaching the dot sight sighting device 100A to various caliber firearms. The bolts 171 and 173 eliminate the need for wrenches that can be misplaced or lost. A dual bullet drop compensation wheel 151A is located beneath the window frame 110 and a windage knob 122 is located on the right side of the body plate 120, above the dual bullet drop compensation wheel 151A. The window frame 110 is also a platform for mounting the laser range finder 1200. In the embodiment of the invention, the window frame 110 is positioned at a first end (or a front end) of the dot sighting device 100A and the magnifier 200 is positioned towards a second end (or a back end) of the dot sighting device 100A. The dual bullet drop compensation wheel 151A is in a form of a wheel that can be turned clock-wise or counter clock-wise for proper bullet drop compensation over distance. The dual bullet drop compensation wheel 151A is disposed parallel to the body plate 120, and is generally disposed horizontally along the length of the dot sight device 100A.

In embodiments of the invention, the dual bullet drop compensation wheel 151A is used to adjust for the proper bullet drop compensation over distances in a manner already discussed above. In embodiments of the invention, the bullet drop compensation device can be achieved by the wheel type depicted in FIG. 14, and scissor type depicted in FIG. 10C. In addition, in embodiments of the invention, the bullet drop compensation device can be achieved by the movable light emitting module 701 depicted in FIG. 10F, for example. The dual bullet drop compensation device can be achieved by switching the gear 704 for various calibers.

As shown in FIGS. 14, 15A and 15B. and in greater detail, the window frame 110 supports one or more rails 113, and the body plate 120 supports a dual bullet drop compensation wheel 151A, a light emitter (or a light emitter housing) 140, a battery case 131, day/night-on/off control switch 132, and an auto or manual brightness switch 133. The elevation control knob 121 is located on the body plate 120, between the transparent lens 112 and the light emitter (or the light emitter housing) 140, and a windage knob stopper/PIN 503 is located on the left side of the body plate 120, above the dual bullet drop compensation wheel 151A. Additionally as shown in FIG. 15B in greater detail, the body plate 120 supports a caliber adjustment knob 153.

As shown in FIG. 15B in greater detail the dot sight device 100A according to an example embodiment of the invention includes an infra-red (IR) detection Sensor 996 and a calibration adjustment knob (a Dual caliber selector) 153. Without using any tools, a user can select a desired caliber setting (e.g., 7.62 mm or 12.7 mm) by, for example, being flipped from one side to another. Also, the sight device 100A may include additional bullet drop compensation wheels to accommodate other dual caliber combinations, such as 5.56 mm/7.62 mm, 12.7 mm/20 mm and others.

In embodiments of the invention, the additional bullet drop compensation wheel 151A can be easily installed into a slot holding the calibration adjustment knob 153 for use with other caliber arms (i.e., 5.56 mm/7.62 mm and 12.7 mm/20 mm caliber arms, for example). The IR detector 996 installed in the front of the sight device 100A detects a beam when a user is targeted by enemies using lasers. The IR detector 996 will provide an early warning about possible enemy fire.

In embodiments of the invention, when using the calibration adjustment knob 153 that can select between 7.62 mm or 12.7 mm caliber arms, the dual bullet drop compensation wheel 151A may be used to compensate in 100 m increments—100, 200, 300, 400, 500, 600, 700, 800, 900, 1000, 1100, 1200, 1300, 1400, 1500 in the case of the 7.62 mm caliber arms (with an effective range=800 m, Max=1200 m), for example. In the case of the 12.77 mm caliber arms compensation may be used for 200, 400, 600, 800, 900, 1000, 1100, 1200, 1300, 1400, 1500, 1600, 1700, 1800, 2000 (in meters). For both caliber arms, the calibration adjustment knob 153 offers 15 setting (or compensations), but the number is not limited thereto. Any other settings may be used. The dual bullet drop compensation wheel 151A may have notches or protrusions that correspond to each of the increments or settings.

Figure 16:
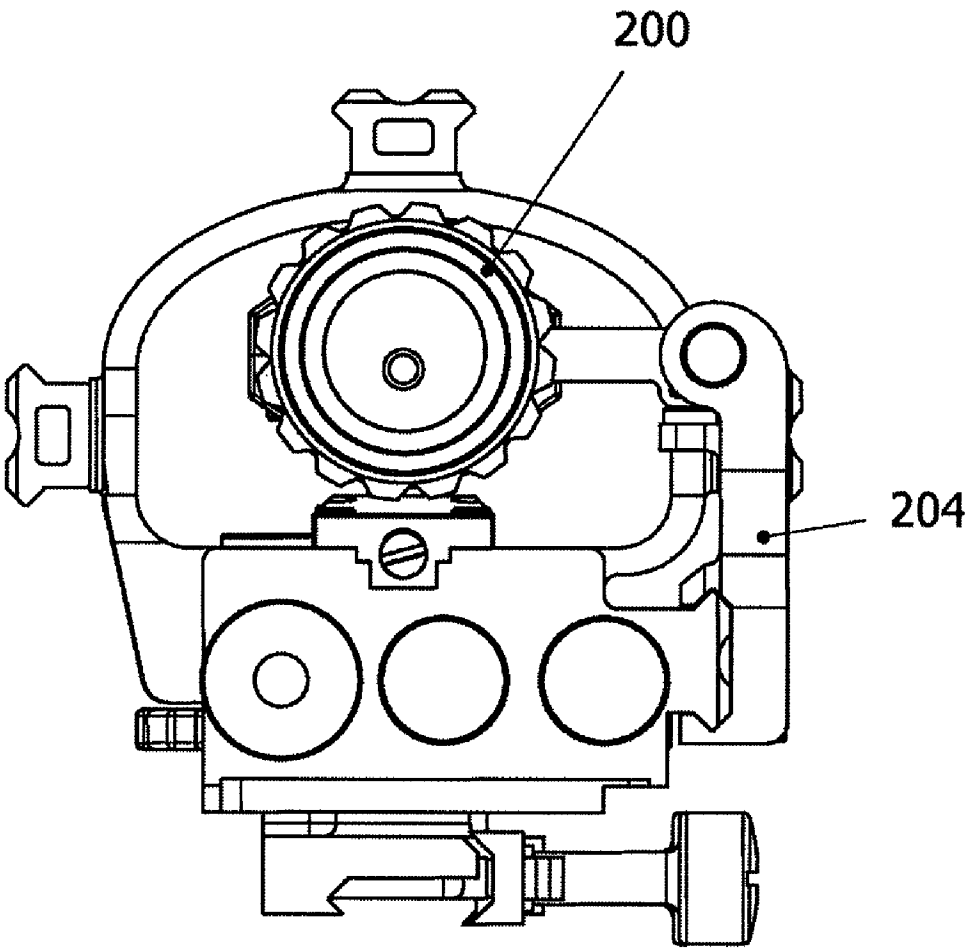
FIG. 16 shows a rear view of a dot sight device with a magnifier in a deployed position according to an example embodiment of the invention.

FIG. 16 shows a rear view of a dot sight device 100A with a magnifier 200, which in this embodiment is a flip type, in a deployed position according to an example embodiment of the invention. The flip mount 204 flips up or down the magnifier 200 into a deployed position or a retracted position. The magnifier 200 is installed on a right side rail and it can be quickly removed to install other devices such as a night vision device, a thermal imager and others. Also, the magnifier 200 and/or the flip mount 204 may be installed on a left side rail or the left side of the dot sight device 100A, or any other position thereof.

Figure 17:
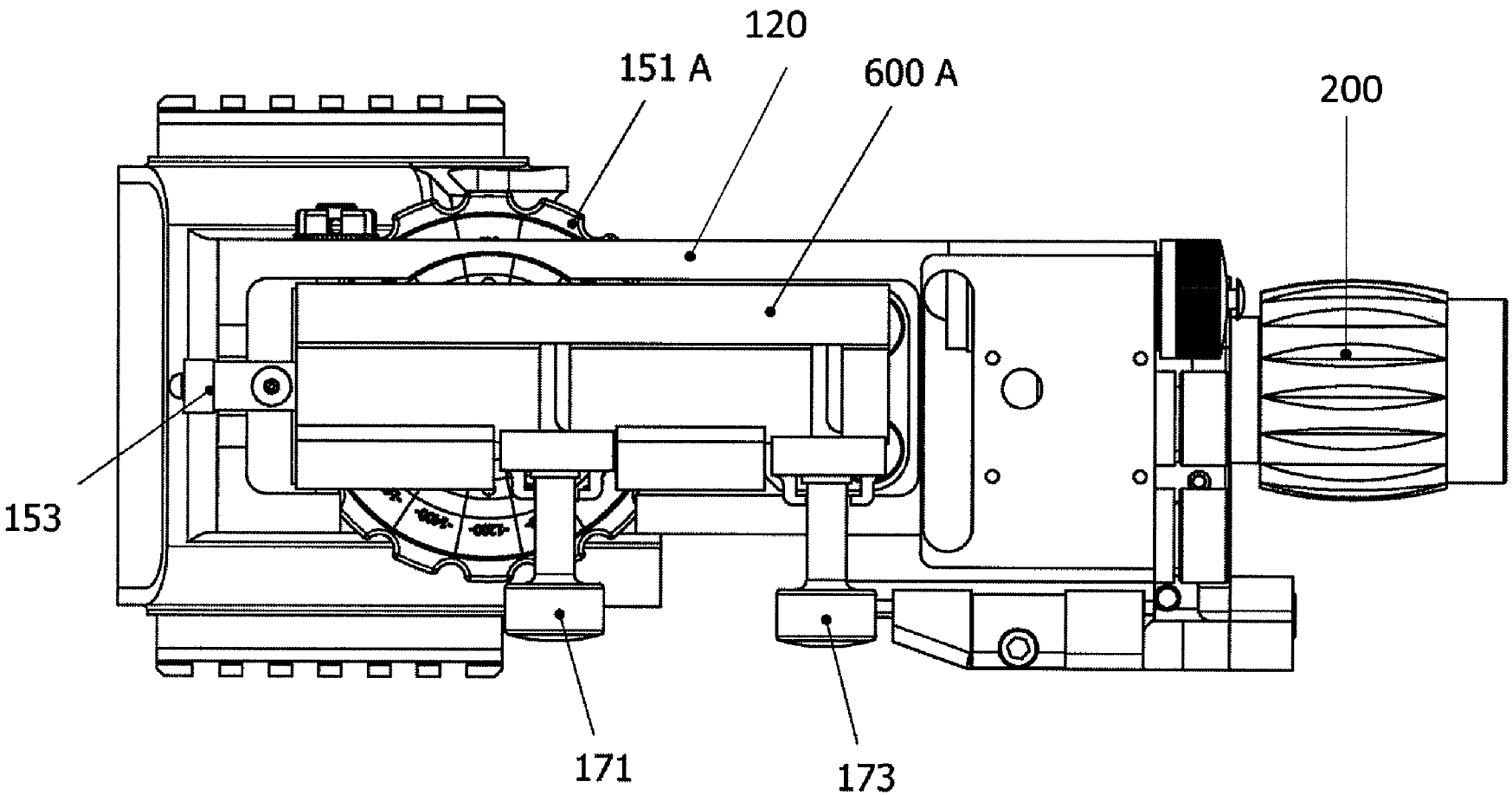
FIG. 17 shows a bottom view of a dot sight device with a magnifier in a deployed position according to an example embodiment of the invention.

FIG. 17 shows a bottom view of a dot sight device with the optional flip type magnifier 200 in a deployed position according to an example embodiment of the invention. The first bolt 171 and the second bolt 171 are attached to a mounting solution 600A, located on the bottom of the body plate 120. Additionally, the dual bullet drop compensation wheel 151A is located above the mounting solution 600A and the caliber adjustment knob 153 is attached in the front of body plate 120.

Figure 18:
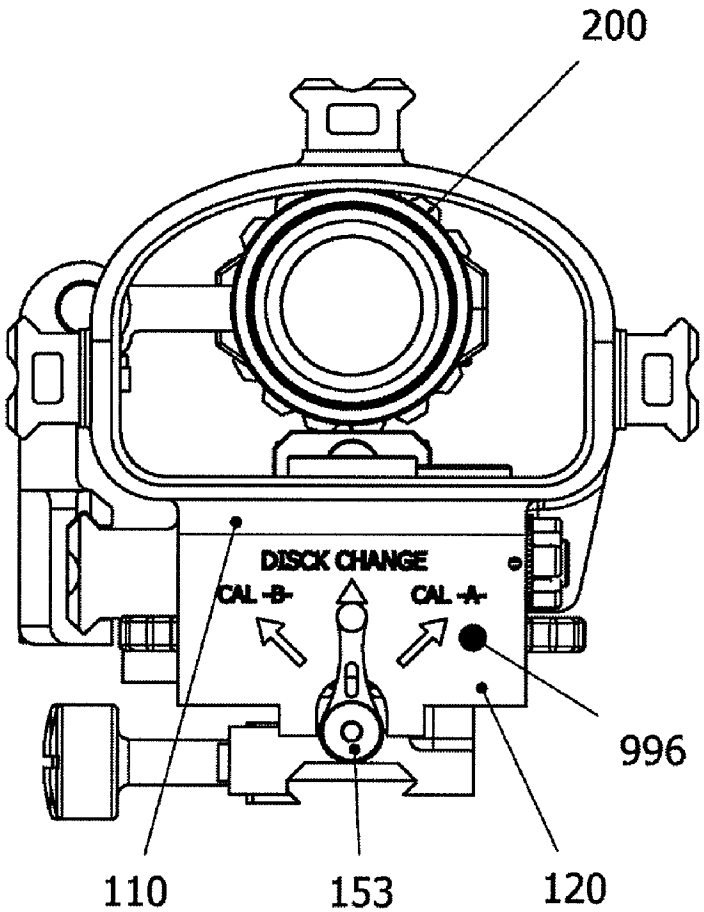
FIG. 18 shows a front-side view of a dot sight device with a magnifier in a deployed position according to an example embodiment of the invention.

FIG. 18 shows a front-side view of a dot sight device with the optional flip type magnifier 200 in the deployed position according to an example embodiment of the invention. The body plate 120 supports the caliber adjustment knob 153 and the IR detector 996, which are located on the front, below the window frame 110.

Figure 19:
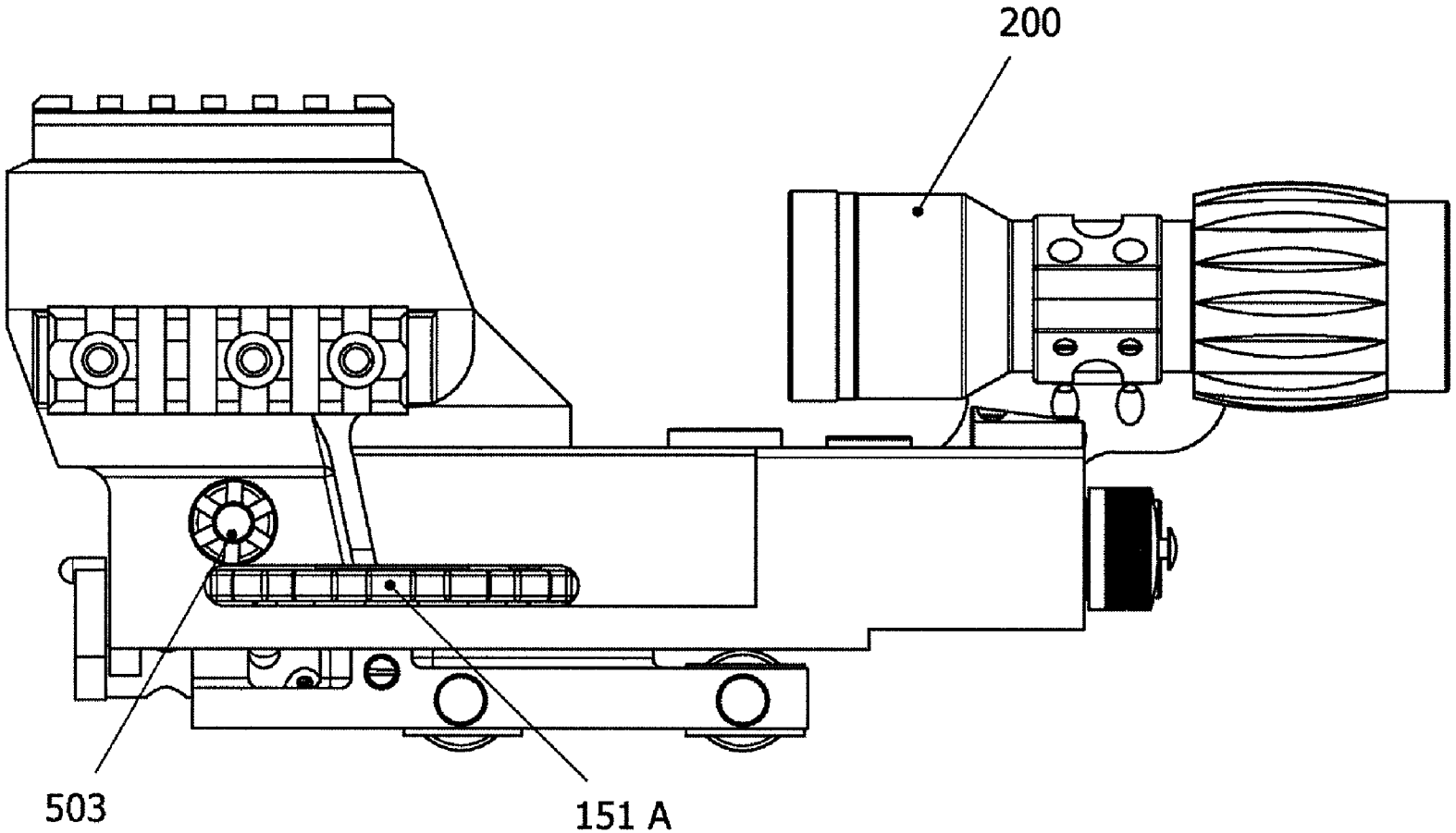
FIG. 19 shows a left-side view of a dot sight device with a magnifier in a deployed position according to an example embodiment of the invention.

FIG. 19 shows a left-side view of a dot sight device with the optional flip type magnifier 200 in the deployed position according to an example embodiment of the invention. The windage knob stopper/PIN 503 is located above the dual bullet drop compensation wheel 151A.

Figure 20:
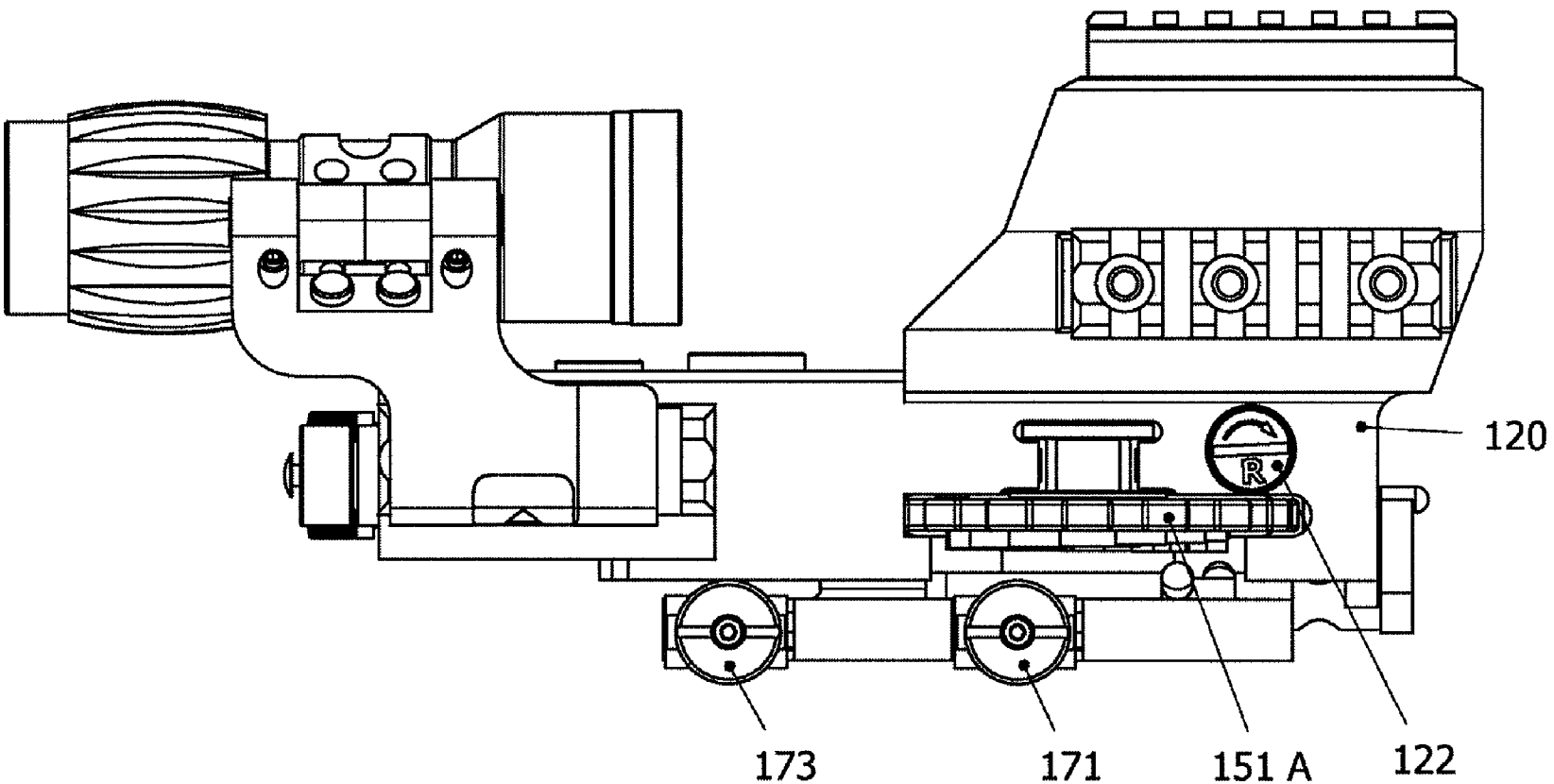
FIG. 20 shows a right-side view of a dot sight device with a magnifier in a deployed position according to an example embodiment of the invention.

FIG. 20 shows a right-side view of a dot sight device with the optional flip type magnifier 200 in the deployed position according to an example embodiment of the invention. The first bolt 171 and the second bolt 173 serves as knobs to mount the body plate 120 on an attachment device, such as a picatinny rail, attached to a firearm. Additionally, the windage knob 122 is located above the dual bullet drop compensation wheel 151A, which is above the first bolt 171 and the second bolt 173.

Figure 21:
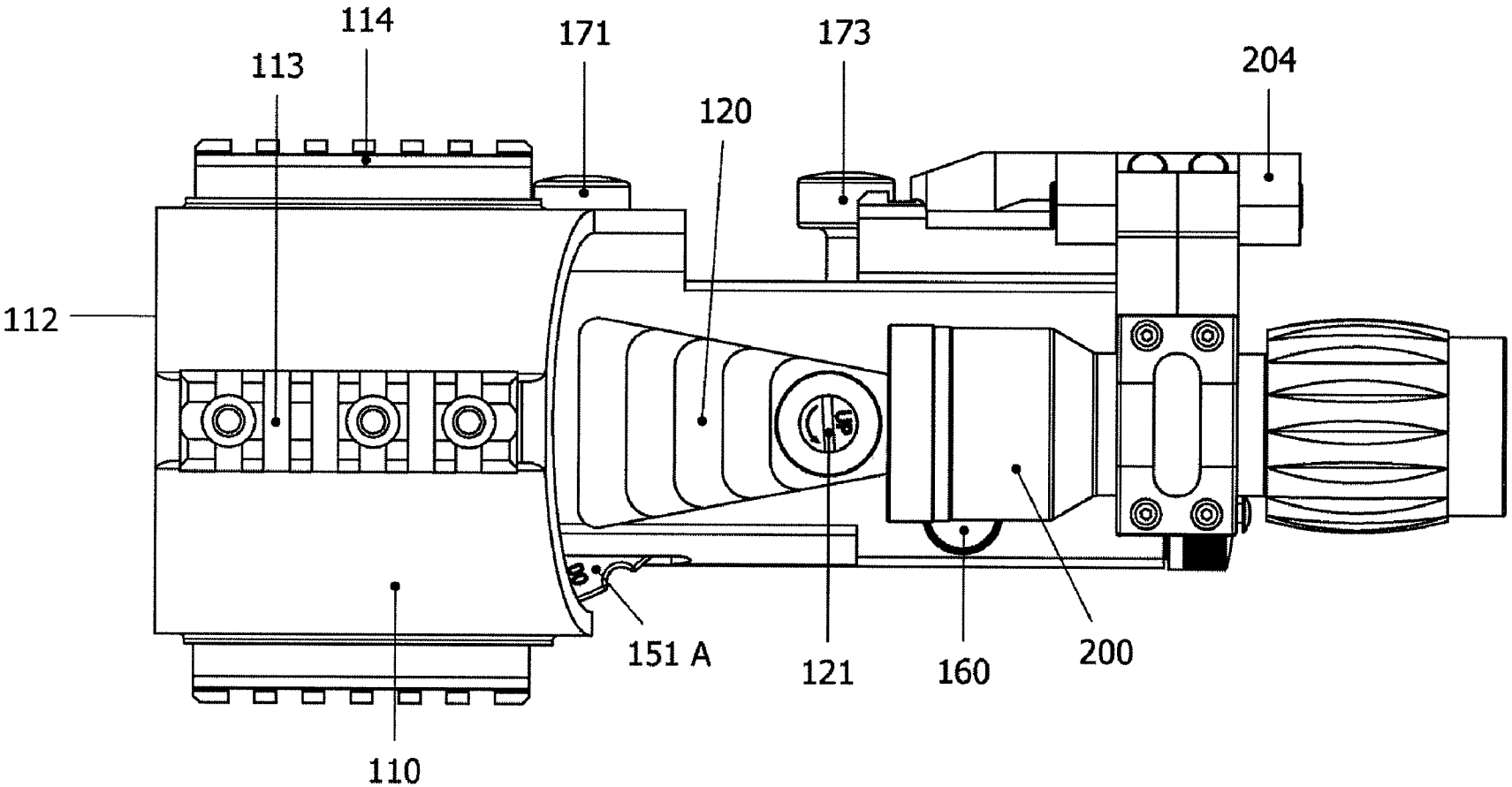
FIG. 21 shows a top view of a dot sight device with a magnifier in a deployed position according to an example embodiment of the invention.

FIG. 21 shows a top view of a dot sight device with the optional flip type magnifier 200 in the deployed position according to an example embodiment of the invention. In the deployed position, the magnifier 200 is aligned with the transparent lens 112 so that the dot, or a target indicator, is centered when the user looks into the magnifier 200. Additionally, the elevation knob 121 is located on the body plate 120, between the magnifier 200 and the transparent lens 112. The top and side rails 113, 114 are located on the window frame 110, which is connected to the body plate 120. The automatic brightness detector 160 is located along the left side wall near the battery case 131.

Figure 22:
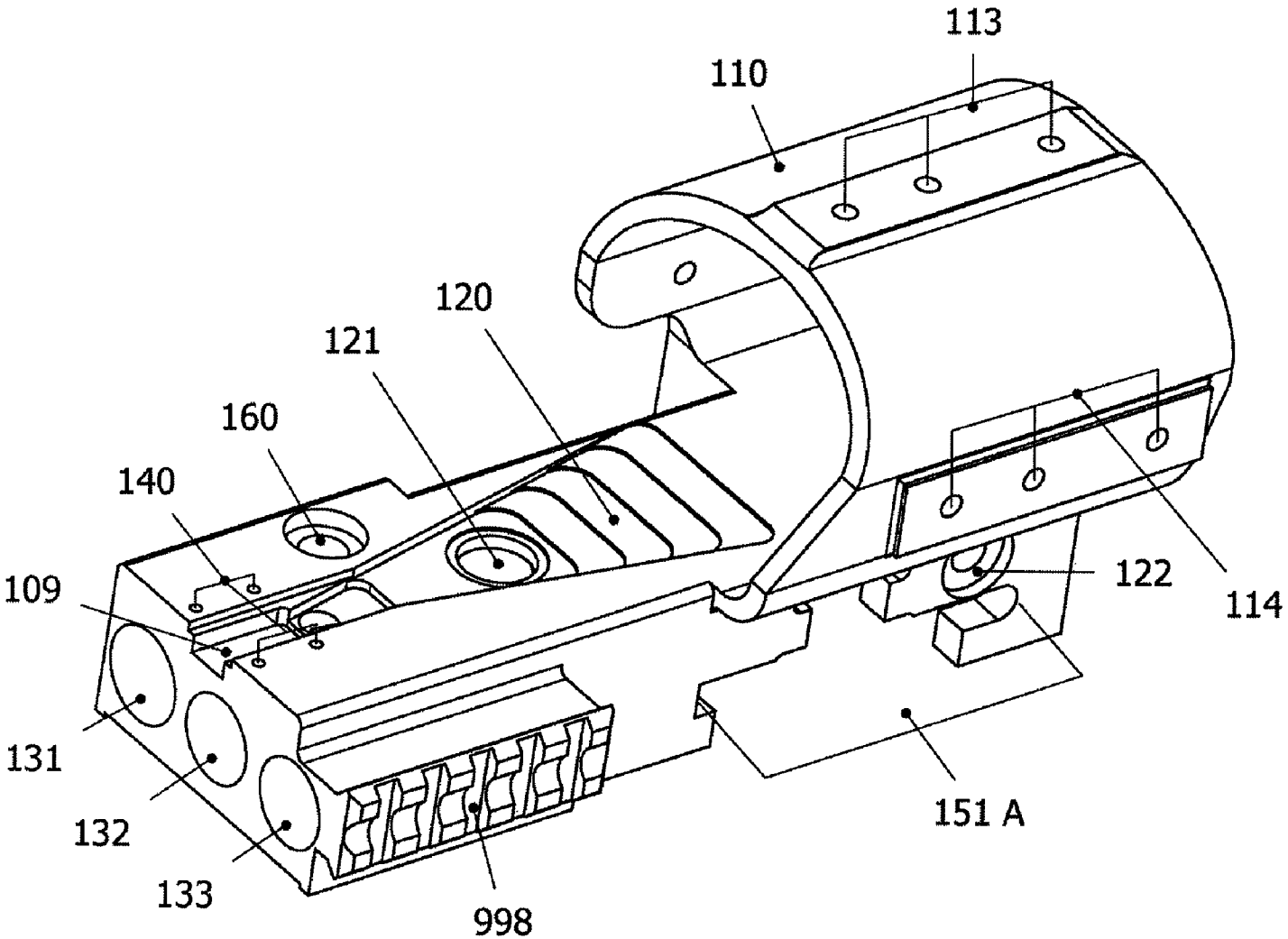
FIG. 22 shows a right-side perspective view of the housing of a red dot sight device as an example embodiment of the invention.

FIG. 22 shows a right-side perspective view of the housing of a red dot sight device as an example embodiment of the invention. The back end of the body plate 120 includes the housing for a battery case 131, day/night-on/off control switch 132, and an auto or manual brightness switch 133. The compartment for the light emitter 140 is located directly above the day/night-on/off control switch 132, and the water drainage hole 109 is located directly in front of the compartment for the light emitter 140. The housing for the automatic brightness detector 160 is located on the left of the water drainage hole 109 and the fixed rail 998 is located on the right of the water drainage hole 109. The window frame 110 includes slots for the top and side rails 113, 114. The slot for the windage knob 122 is located beneath the window frame 110 and the slot for the dual bullet drop compensation wheel 151A is located beneath the slot for the windage knob 122, beneath the body plate 120.

Figure 23A:
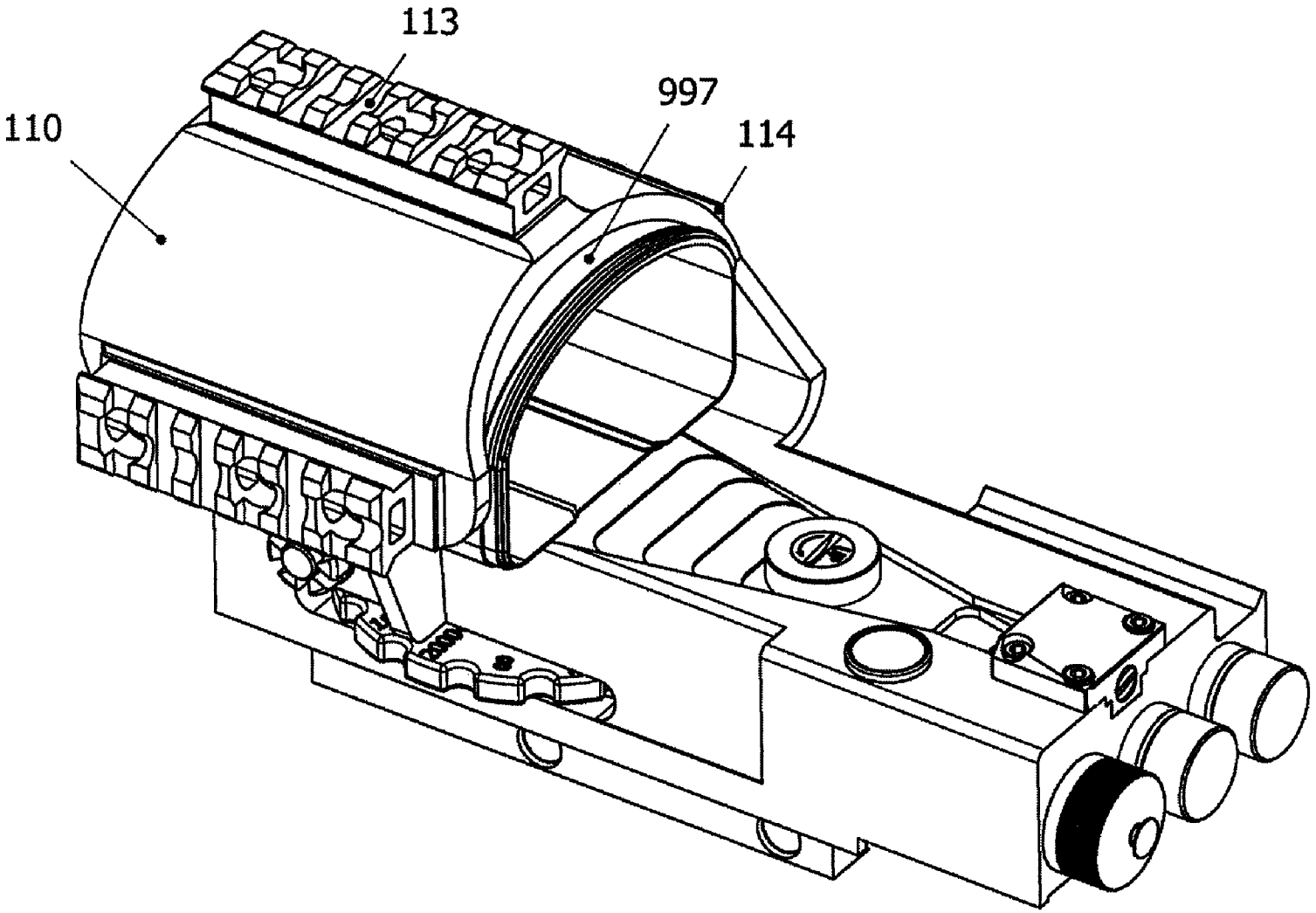
FIG. 23A shows a left-side perspective view of a red dot sight with a protective cover installed in a retracted position as an example embodiment of the invention.

FIG. 23A shows a left-side perspective view of a red dot sight with a protective cover 997 installed in a retracted position as an example embodiment of the invention. The protective cover 997 is located inside the window frame 110. Also, as an example embodiment of the invention in FIG. 23A, the window frame 110 includes a top and side rails 113, 114.

Figure 23B:
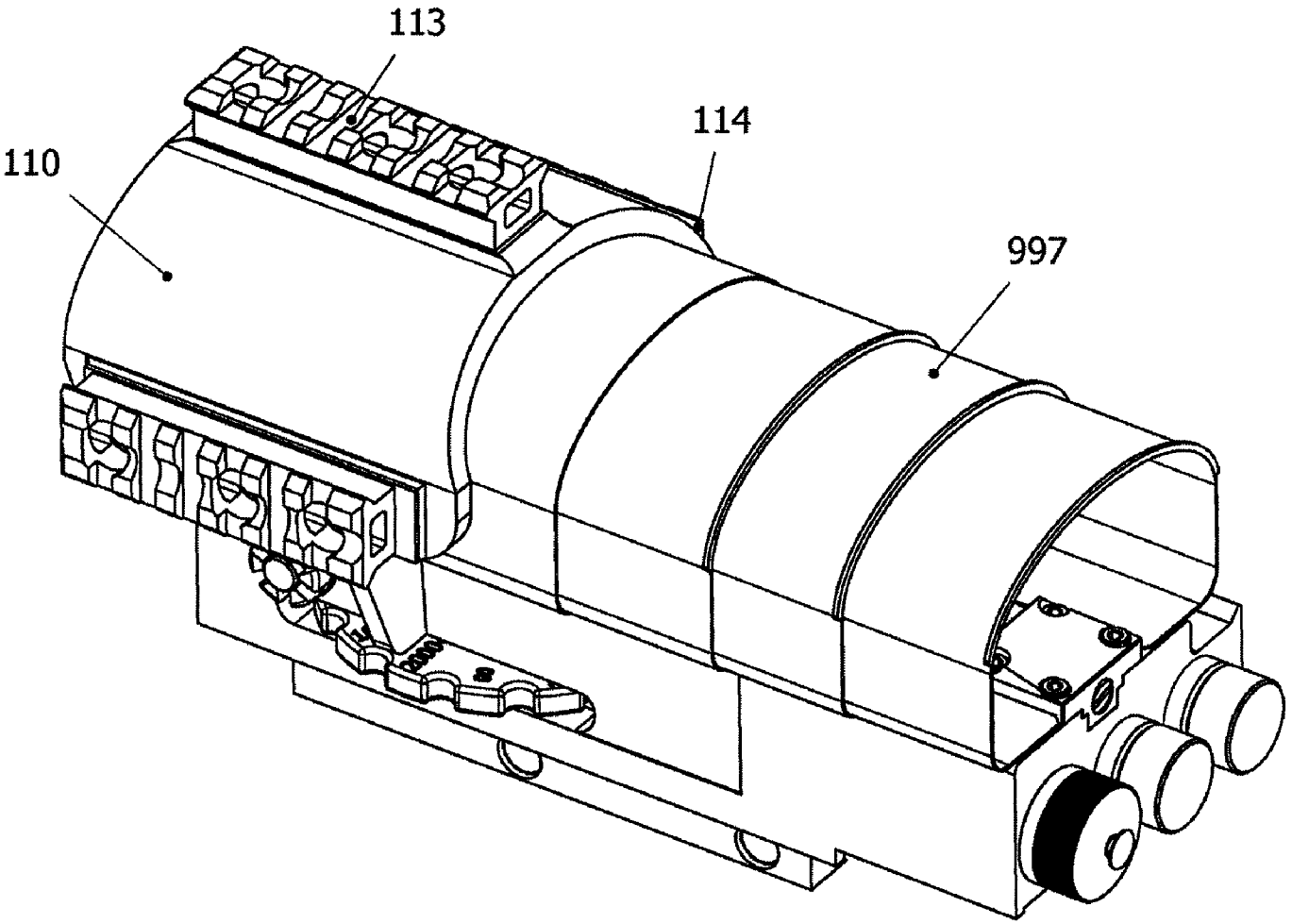
FIG. 23B shows a left-side perspective view of a red dot sight with a protected cover installed in a deployed position as an example embodiment of the invention.

FIG. 23B shows a left-side perspective view of a red dot sight with the protected cover 997 installed in a deployed position as an example embodiment of the invention. The deployed protective cover 997 extends along the body plate 120 to protect encompassing units within the cover from rain, snow, dirt, moisture, along other articles that may interfere with proper usage of the red dot sight. The deployed protective cover 997 will stop accumulation of heavy snow, dirt, and rain that might prevent LED light from projecting a red dot on the lens 112.

The protective cover 997 is segmented, with each segment decreasing in size from left to right for the capability of retracting and deploying the protective cover 997. In embodiments of the invention, the protective cover 997 is telescoping. The protective cover 997 is designed to be used with or without the magnifier 200.

Figure 24:
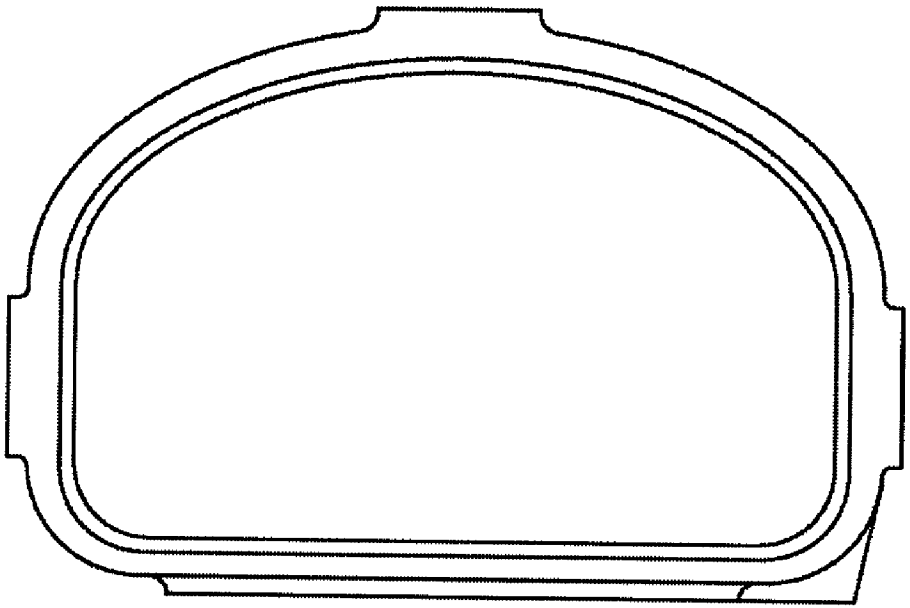
FIG. 24 shows a lens shape and size for a dot sight device according to an example embodiment of the invention.

FIG. 24 shows a lens shape and a size for a dot sight device according to an example embodiment of the invention. Shown is a rounded pentagon shape 907.

In embodiments of the invention, one dot sight device may be used for all or a plurality of calibers just by changing a dual bullet drop compensation wheel. Accordingly, the dot sight device may come with additional dual bullet drop compensation wheels corresponding to a different set of calibers. In embodiments of the invention, each set of calibers may include two calibers. Accordingly, a first dual bullet drop compensation wheel corresponds to one set (a first set) of two calibers, and is exchangeable with another dual bullet drop compensation wheel that corresponds to another set (a second set) of two calibers. The first set of two calibers may be completely different from the second set of two calibers, or one of the two calibers from the first set may be the same as one of the two calibers from the second set.

Although example embodiments have been described with reference to a number of illustrative examples, it should be understood that numerous other modifications and changes can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dot sight device comprising:

a window frame enclosing a transparent lens;

a body plate extending from the window frame;

a light emitter disposed on the body plate, and configured to emit a light that forms a pattern on the transparent lens;

a brightness detector disposed at a side of the body plate;

a brightness detector switch configured to selectively activate the brightness detector;

a brightness switch configured to enable a user to manually change a brightness of the pattern;

a battery case disposed at a rear of the body plate;

a magnifier movably attached to the body plate;

a caliber adjustment knob disposed on the body plate, and configured to enable targeting by firearms of different calibers;

a dual bullet drop compensation wheel disposed in the body plate, and configured for bullet drop compensation over distances in use with the caliber adjustment knob for targeting of the firearms of different calibers; and an infrared (IR) detector disposed at a front of the body plate.

2. The dot sight device of claim 1, further comprising a plurality of bolts configured to attach the dot sight device to firearms of different calibers.

3. The dot sight device of claim 2, wherein the different calibers include 5.56 mm, 7.62 mm, 8.6 mm, 12.7 mm, and 20 mm.

4. The dot sight device of claim 3, wherein the caliber adjustment knob is a dual caliber selector that adjust between 5.56 mm and 7.62 mm, 8.6 mm and 12.7 mm, 12.7 mm and 20 mm.

5. The dot sight device of claim 3, wherein the caliber adjustment knob is a dual caliber selector that adjust between any two calibers chosen from 5.56 mm, 7.62 mm, 8.6 mm, 12.7 mm, and 20 mm.

6. The dot sight device of claim 1, wherein the transparent lens has at least one of a rectangular shape, a windshield shape, a trapezoid shape, a lens shape, an oval shape, a rounded pentagon shape, and an octagonal shape.

7. The dot sight device of claim 1, wherein the transparent lens has an area configured to display targeting information.

8. The dot sight device of claim 1, wherein the magnifier is movably attached to the body plate by one of a swing mount and a flip mount.

9. The dot sight device of claim 1, further comprising a protective window disposed in front of the transparent lens, and configured to protect the transparent lens and to reduce reflection from the transparent lens.

10. The dot sight device of claim 1, further comprising a polarized filter or a honeycomb in front of the transparent lens, the polarized filter or the honeycomb being configured to protect the transparent lens and to reduce reflection from the transparent lens.

11. The dot sight device of claim 1, further comprising a drainage hole formed through the body plate, located in front of the light emitter, and configured to drain accumulation of at least one of dirt, snow and water quickly and efficiently.

12. The dot sight device of claim 1, wherein the light emitter includes an LED lens protector configured to reduce accumulation of at least one of dirt, snow and water.

13. The dot sight device of claim 1, further comprising a bullet drop compensation device, wherein the dual bullet drop compensation wheel operates the bullet drop compensation device.

14. The dot sight device of claim 13, wherein the bullet drop compensation device is one of a scissor type and a wheel type.

15. The dot sight device of claim 1, further comprising a light emitter module that houses the light emitter, wherein the bullet drop compensation device is configured to cause movement of the light emitter module.

16. The dot sight device of claim 1, wherein the light emitter emits at least one of visible light or infrared (IR) light.

17. The dot sight device of claim 1, wherein the light emitter emits an infrared (IR) light, and the transparent lens is coated with a material that converts the IR light into visible light.

18. The dot sight device of claim 1, wherein the visible light is one of red or green color.

19. The dot sight device of claim 1, further comprising at least one picatinny rail attached to at least one of the window frame and the body plate.

20. The dot sight device of claim 1, further comprising a laser distance finder attached to the window frame.

21. The dot sight device of claim 1, wherein the light emitter includes a light emitting diode (LED), and at least one of the light emitter and the LED is movable to use in targeting of firearms of different calibers.

22. The dot sight device of claim 1, wherein the dual bullet drop compensation wheel corresponds to one set of two calibers, and is exchangeable with another dual bullet drop compensation wheel corresponding to another set of two calibers.

* * * * *